US010514133B2

(12) United States Patent
Sonneman et al.

(10) Patent No.: US 10,514,133 B2
(45) Date of Patent: Dec. 24, 2019

(54) LIGHTING SYSTEM

(71) Applicant: Contemporary Visions, LLC, Larchmont, NY (US)

(72) Inventors: Robert A. Sonneman, Mamaroneck, NY (US); Christian N. Garnett, Mount Kisco, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 16/203,162

(22) Filed: Nov. 28, 2018

(65) Prior Publication Data

US 2019/0162369 A1 May 30, 2019

Related U.S. Application Data

(60) Provisional application No. 62/591,413, filed on Nov. 28, 2017.

(51) Int. Cl.

| | |
|---|---|
| ***F21K 9/237*** | (2016.01) |
| ***F21K 9/238*** | (2016.01) |
| ***F21V 33/00*** | (2006.01) |
| ***F21S 8/04*** | (2006.01) |
| ***F21V 15/01*** | (2006.01) |

(52) U.S. Cl.

CPC ..... *F21K 9/237* (2016.08); *F21K 9/238* (2016.08); *F21S 8/043* (2013.01); *F21V 15/01* (2013.01); *F21V 33/0028* (2013.01)

(58) Field of Classification Search

CPC ..... F21K 9/237; F21V 15/01; F21S 8/043

See application file for complete search history.

(56) References Cited

U.S. PATENT DOCUMENTS

| | | | | |
|---|---|---|---|---|
| 8,807,780 | B2 | 8/2014 | Napier et al. | |
| 2011/0122608 | A1* | 5/2011 | Napier | F21V 21/104 362/184 |
| 2012/0313512 | A1* | 12/2012 | Yamada | E06B 9/303 313/504 |
| 2013/0294059 | A1* | 11/2013 | Galluccio | F21V 7/0008 362/218 |
| 2014/0268720 | A1* | 9/2014 | Dungan | F21V 23/026 362/218 |
| 2016/0131312 | A1 | 5/2016 | May | |
| 2016/0323950 | A1 | 11/2016 | Ogg et al. | |

FOREIGN PATENT DOCUMENTS

| | | |
|---|---|---|
| JP | H10-184814 A | 7/1998 |

* cited by examiner

*Primary Examiner* — Evan P Dzierzynski

(74) *Attorney, Agent, or Firm* — Gottlieb, Rackman & Reisman, P.C.

(57) ABSTRACT

A lighting system that includes at least one illuminable pendant that is affixable to and adjustable vertically about at least two cable that are suspended from a surface and transfer power to the illuminable pendant to enable the illuminable pendant to emit light therefrom.

24 Claims, 26 Drawing Sheets

LIGHTING SYSTEM

CROSS-REFERENCE TO RELATED APPLICATION

This application claims priority to U.S. Provisional Patent Application No. 62/591,413, filed Nov. 28, 2017, the contents of which are incorporated herein by reference in its entirety.

FIELD OF THE INVENTION

This invention relates generally to a luminaire and more specifically to a lighting system that includes at least one illuminable pendant that is affixable to and adjustable vertically about at least two cable that are suspended from a surface and transfer power to the illuminable pendant to enable the illuminable pendant to emit light therefrom.

BACKGROUND OF THE INVENTION

Pendant light fixtures are popular and come in various configurations ranging from small single light units to large multiple light units that are hung from a surface (e.g., a ceiling). For example, known pendant light fixtures can range from one illuminable pendant that is suspended from a single cord to multiple illuminable pendants that are suspended from multiple cords. Light fixtures that include pendants are typically chosen based upon the aesthetics of the luminaire, the amount of light desired in a space and the location where the pendant will be hung. Commonly, such light fixtures are rarely adjustable, if at all, and do not typically allow for modifications of the pendant.

SUMMARY OF THE INVENTION

In general, the present disclosure is directed to a luminaire that includes at least one illuminable pendant that is affixable to and adjustable vertically about at least two cable that are suspended from a surface and electrically isolate and transfer power to the illuminable pendant to enable the illuminable pendant to emit light therefrom.

According to an exemplary embodiment, the present disclosure is directed to a lighting system that includes a housing that is configured to allow light to be emitted therethrough, at least one light source arranged within the housing, a first cable that is configured to transmit one of a positive and a negative current, a second cable that is spaced from the first cable and that is configured to transmit the other of a positive and a negative current, a first gripper assembly that is arranged within the housing and configured to receive the first cable and a second gripper assembly that is arranged within the housing and configured to receive the second cable. When the first gripper assembly and the second gripper assembly are secured to the first cable and the second cable, respectively, the positive current and the negative current are transferable to the at least one light source to illuminate the at least one light source.

The housing can include a first enclosure member, a second enclosure member and at least one diffuser (e.g., transparent or translucent) through which light can be emitted therethrough. The housing can have a generally circular cross-section, can be made by an extrusion process and can be formed from one or more extruded pieces that are connected to each other. The housing can be delimited at a first end by a first end cap and at a second end by a second end cap.

At least one printed circuit board and at least one first light source that is affixed to the at least one printed circuit board can be fixed within the housing. The at least one first light source can, for example, be plurality of light-emitting diodes (LEDs). Alternatively, the lighting system can include at least one first printed circuit board and at least one first light source (e.g., LEDs) that is affixed to the at least one first printed circuit board and at least one second printed circuit board and at least one second light source (e.g., LEDs) that is affixed to the at least one second printed circuit board. The circuit boards can be fixed to a respective one of the end caps.

The first gripper assembly and the second gripper assembly can each includes a first housing member and a second housing member that is affixable to the first housing member. The first housing member and the second housing member can be insulating components comprised of a polymeric material. The first housing member can include a flange, a first sidewall that extends in a first direction from the flange and a second sidewall that extends in a second direction from the flange. The first sidewall can include a tapered internal surface and the second sidewall can include at least one recess.

The first gripper assembly and the second gripper assembly can each include a housing member, a plunger that is arranged concentric within the housing member, a plurality of bearings that extend about an internal surface of the plunger and a plate that is contactable with the plunger. The plunger and the plate can be conductive elements that are configured to transfer electricity from the first cable and the second cable to the at least one first light source. The housing member can include a plurality of recesses through which the plate extends and a pre-tensioned spring can be arranged within the housing and configured to tension the plunger against an internal surface of the housing. The recesses allow the plate to travel about the recesses when plunger is depressed within the housing and allow the wings of the plate to extend outwardly from the gripper assemblies and transfer electricity to the light sources.

The gripper assembly can include a cap that is configured to extend over an end of the plunger and be secured to the plunger, pulling the plunger upward within the housing and in turn forcing the bearings to grip and hold the first cable and the second cable, fixing the first gripper assembly and the second gripper assembly at a position about the first cable and the second cable, respectively.

The first cable can extend beyond the housing and the first gripper assembly and the second cable can extend beyond the housing and the second gripper assembly.

According to another exemplary embodiment, the present disclosure is directed to a method of assembling a lighting system that comprises the steps of providing at least one first cable configured to transmit a positive current, at least one second cable configured to transmit a negative current, a plurality of housings, a pair of gripper assemblies arranged within each one of the housings and at least one light source arranged in each housing; feeding the at least one first cable through a first one of the gripper assemblies of each of the housings; feeding the at least one second cable through a second one of the gripper assemblies of each of the housings; adjusting the position of each of the housings about the at least one first cable and the at least one second cable; and securing the one of the gripper assemblies at a position about the at least one first cable and the at least one second cable.

Each of the gripper assemblies can include a housing member, a plunger that is arranged concentric within the housing member, a plurality of bearings that extend about an internal surface of the plunger and a plate that is contactable with the plunger.

The method can further include the step of moving the plunger in an upward direction which in turn forces the bearings to move inwardly toward the at least one first cable and the at least one second cable to grip and hold the at least one first cable and the at least one second cable, fixing the gripper assemblies at a position about the at least one first cable and the at least one second cable, respectively.

The gripper assembly provides for adjustment and removable attachment of the cables of to the housings so that the configuration of the lighting system can be changed as desired. The gripper assembly can be manipulated by the end user to achieve a desired look.

In an embodiment, two pendant housings can extend about a first plane in a first direction, two additional pendant housings can extend about a second plane in a direction that is different from the two pendant housings. Additional pendant housings can be added to obtain various numbers of tiers of lighting. Yet another configuration may include several pendant housings disposed at different heights or tiers with some of the pendant housings being perpendicular to other pendant housings.

DETAILED DESCRIPTION OF EMBODIMENTS OF THE INVENTION

With reference to the drawings, wherein the same reference number indicates the same element throughout, exemplary embodiments of a lighting system that includes at least one illuminable pendant will be described.

Figure 1:
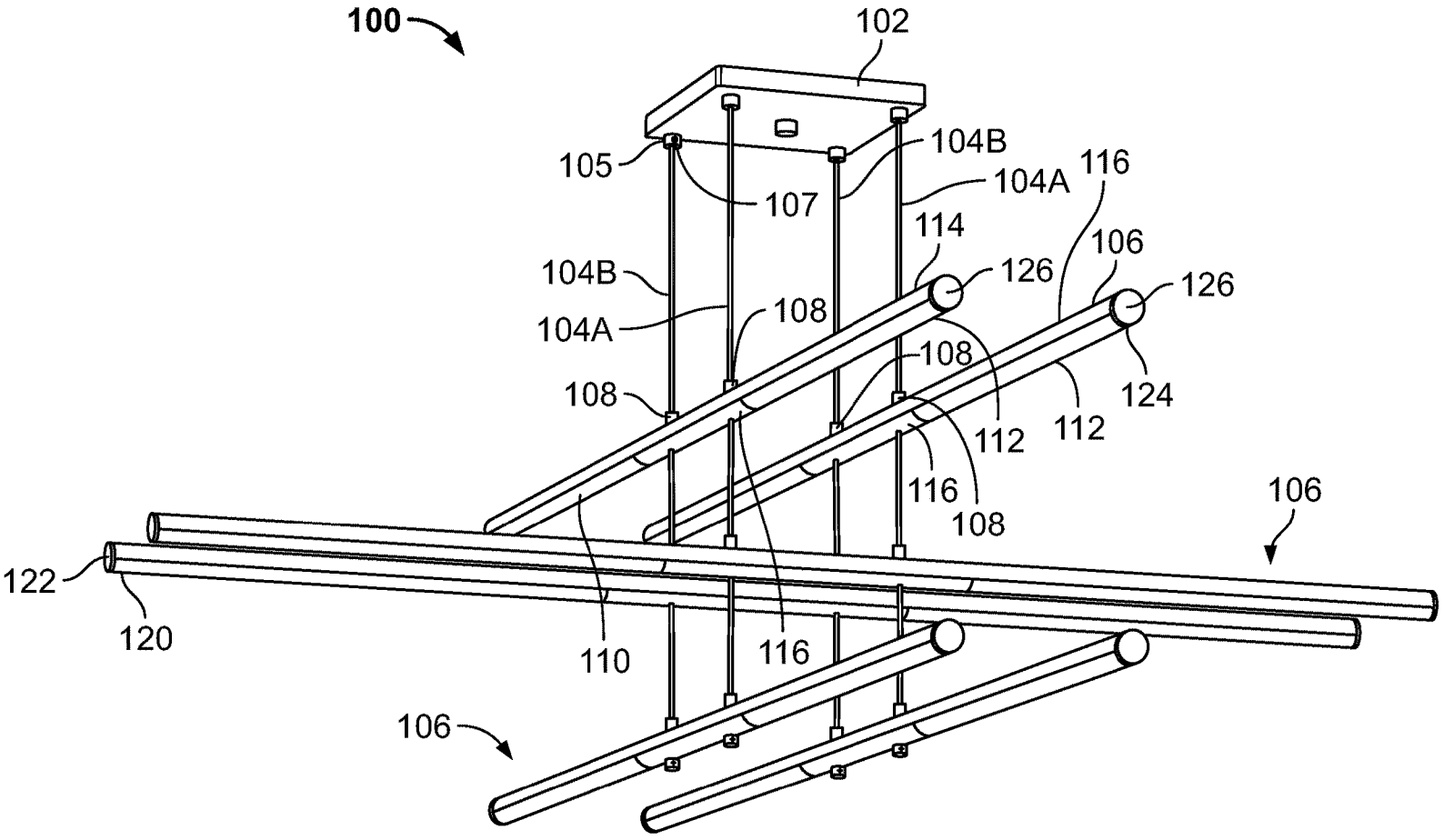
FIG. 1 is a perspective view of lighting system that includes a plurality of pendants according to an exemplary embodiment of the present invention.
Figure 2:
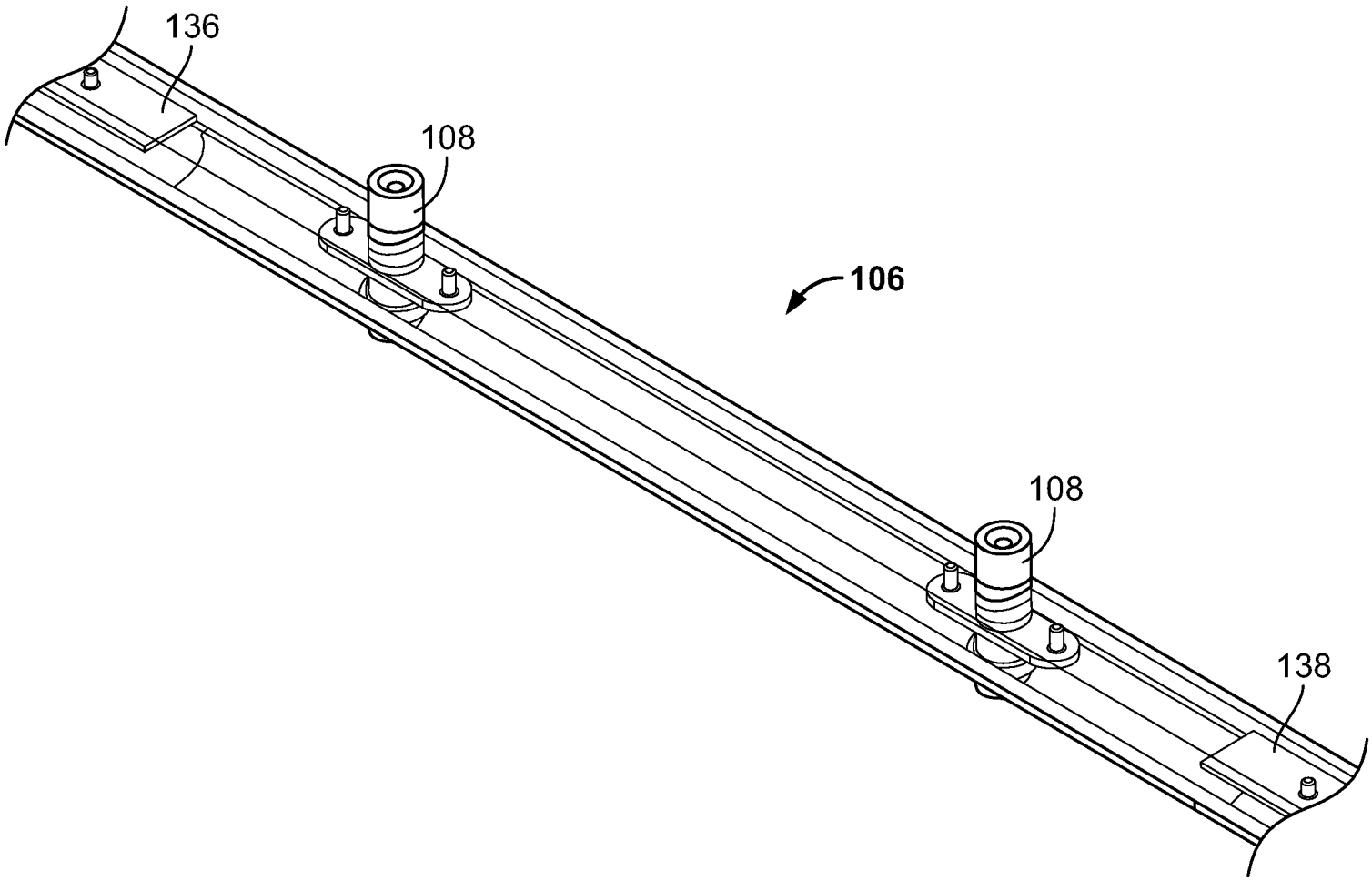
FIG. 2 is a partial perspective view of a pendant housing of a lighting system with gripper assemblies arranged therein according to an exemplary embodiment of the present invention.

FIG. 1 illustrates a lighting system 100 that generally includes a canopy 102, a plurality of pairs of cables 104A, 104B that extend from the canopy 102, a plurality of bushings 105 through which each of the cables 104A, 104B are fed and that abut the canopy 102 to fix the cables 104A, 104B by way of a fastener 107 (e.g., set screw) at a desired position, a plurality of illuminable pendant housings 106 and a plurality of gripper assemblies 108.

The canopy 102 supports the housings 106 from a surface (e.g., a ceiling or other similar structure) and keeps a power supply that is transferred to each illuminable pendant housings 106 hidden from view as will be discussed below in more detail.

As shown in FIG. 1, pairs of cables 104A, 104B, which are spaced equidistant from each other, extend substantially parallel to each other from the canopy 102 and are each attachable to a respective one of the housings 106 by a respective one of the gripper assemblies 108 that is arranged within and extends from each housing 106. Light can be emitted through at least one region of each housing 106 to illuminate a space. As shown, the housings 106 each include a pair of gripper assemblies 108, a first diffuser 110 and a second diffuser 112 that is spaced from the first diffuser 110 through which light can project. The diffusers 110, 112, which can be transparent (e.g., acrylic) or translucent, are configured to allow light to be emitted therethrough.

As shown in FIG. 1, the housings 106, which are suspended from the canopy 102 in tandem pairs on multiple levels that are perpendicular to each other, are elongated tubular bodies or rods. However, the shape of the housings 106 should not be limited to a cylindrical shape and it should be understood that the housings 106 can take the form of any other known geometric shape such as a rectangle, square, circle or ellipse.

In addition to the diffusers 110, 112 noted above, the housings 106 include a first enclosure member 114 that extends the length of the housing 106 and a second enclosure member 116 that is configured to be arranged between the first diffuser 110 and the second diffuser 112 and that is configured to mate (e.g., tongue and groove, press-fit, adhesive, fasteners) with the first enclosure member 114 (see FIG. 3) such that the diffusers 110, 112 and the second enclosure member 116 (see FIG. 3) together extend a same length as the first enclosure member 114 to form an internal space within each housing 106. The housing 106 is delimited at a first end 120 by a first end cap 122 and a second end 124 by a second end cap 126. The end caps 122, 126 are shown in more detail in FIGS. 7A-7F. The overall length of each housing 106 can vary depending on desired configuration. For example, each housing 106 can be twelve inches long, twenty-four inches long, thirty-six inches long, etc.

As illustrated by viewing FIGS. 2-5, prior to combining the first enclosure member 114 with the second enclosure member 116 and the diffusers 110, 112, the gripper assemblies 108, which fix each housing 106 at a desired position along a respective cable 104A, 104B, are secured within the housings 106.

Figure 3:
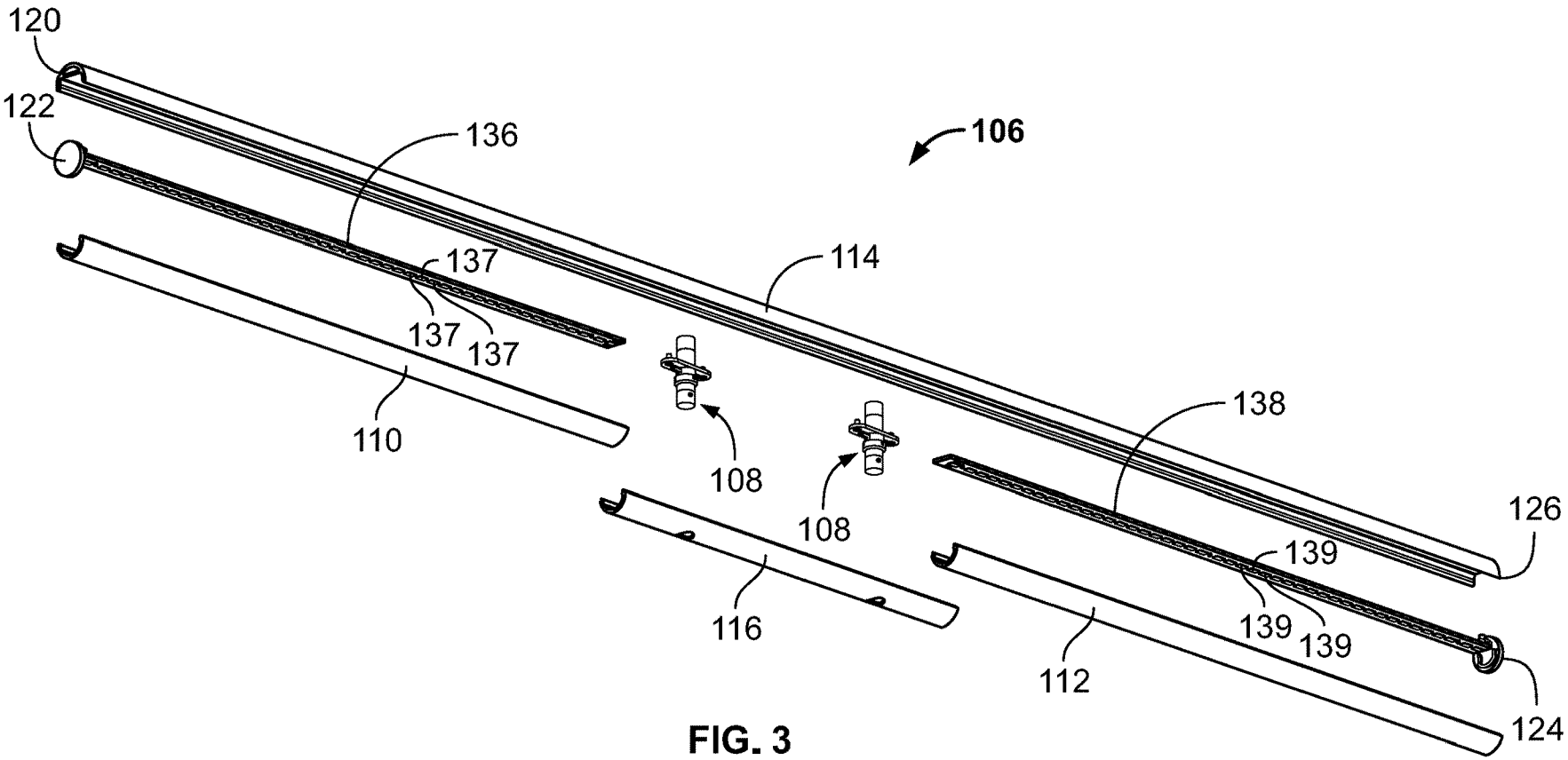
FIGS. 3 and 4 are exploded views of a pendant housing of a lighting system according to an exemplary embodiment of the present invention.
Figure 4:
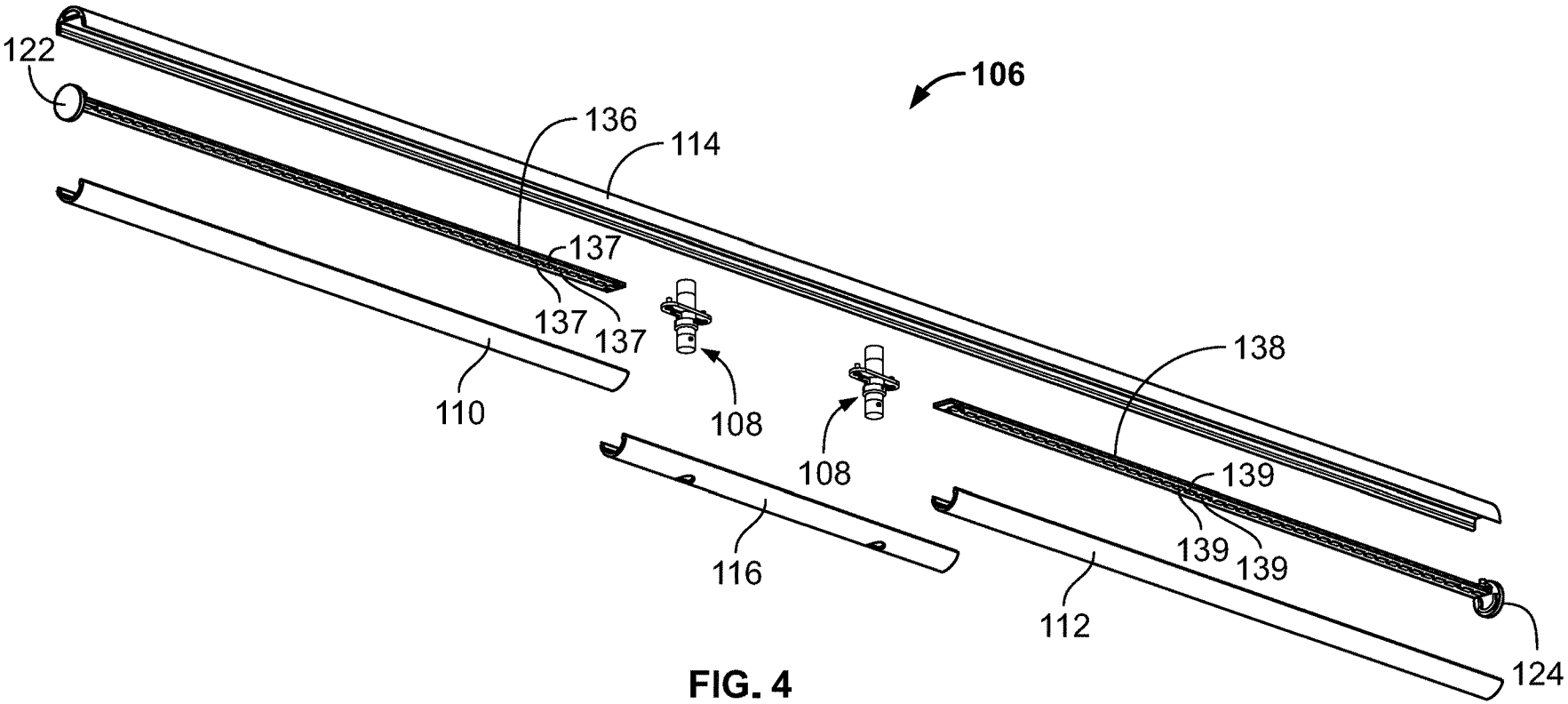
Figure 5:
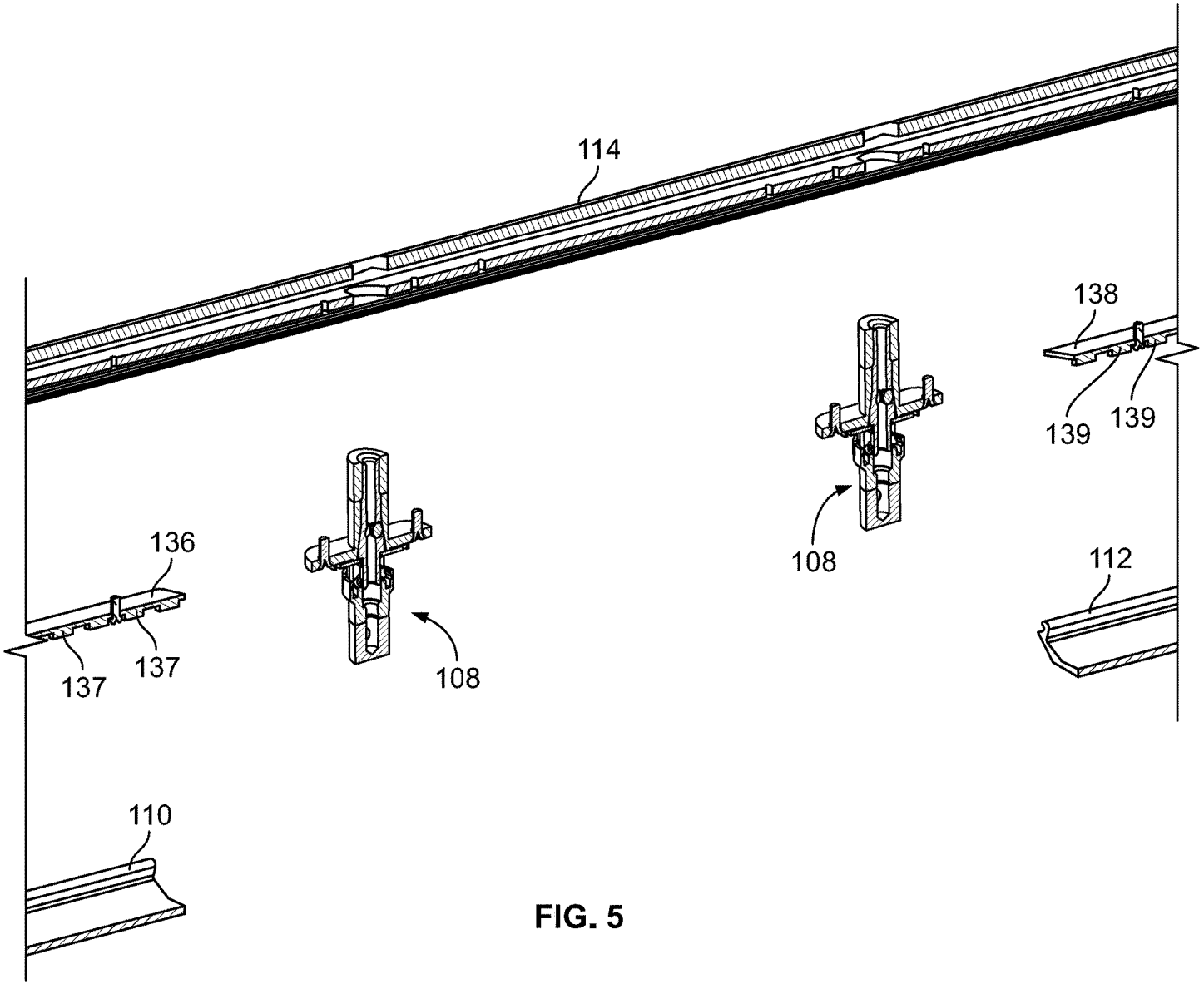
FIG. 5 is a partial cross-sectional view of the pendant housing and gripper assemblies associated therewith of a lighting system shown in FIGS. 3 and 4 according to an exemplary embodiment of the present invention.
Figure 6A:
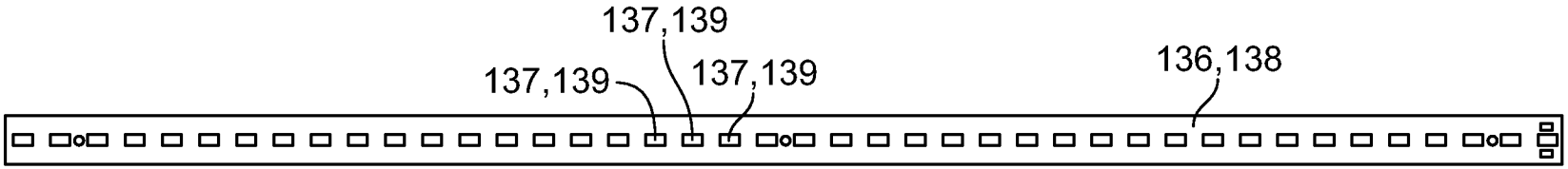
FIGS. 6A-6C are various views of a circuit board with a plurality of light sources fixed thereto that is arrangeable within a pendant housing of a lighting system according to an exemplary embodiment of the present invention.
Figure 6B:
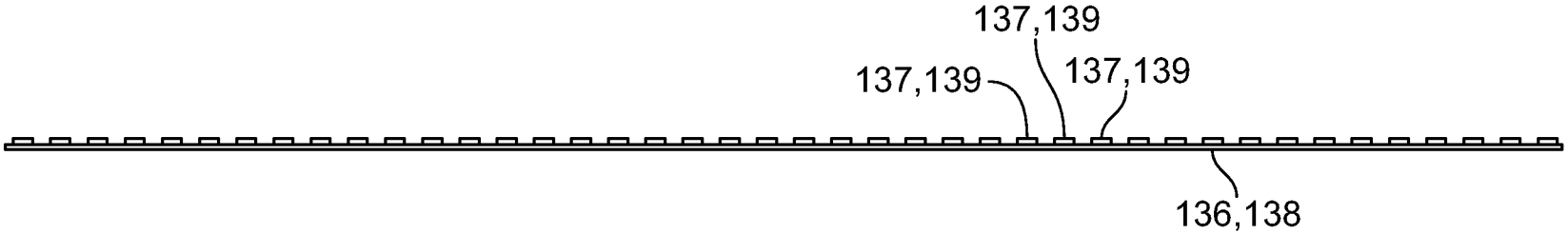
Figure 6C:
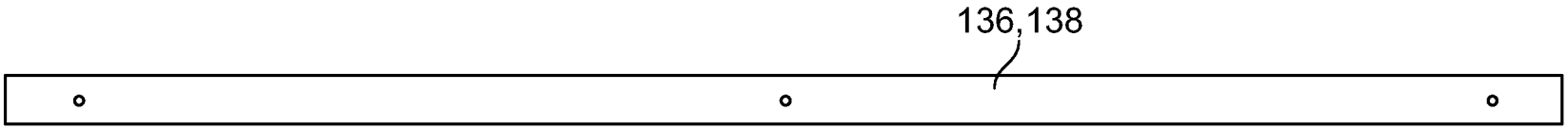
Figure 7A:
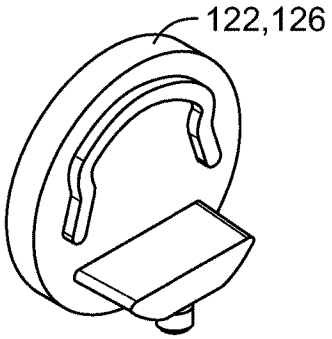
FIGS. 7A-7F are various views of an end cap of a pendant housing of a lighting system according to an exemplary embodiment of the present invention.
Figure 7F:
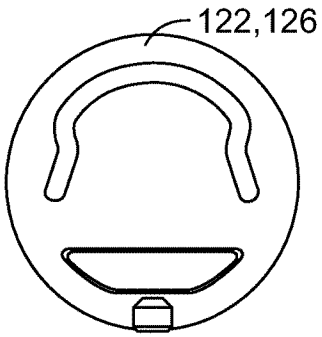
Figure 7C:
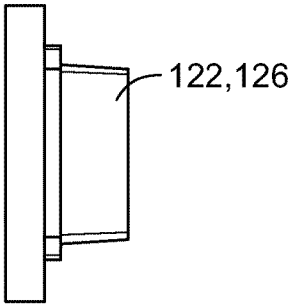
Figure 7D:
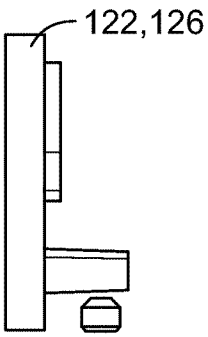
Figure 7E:
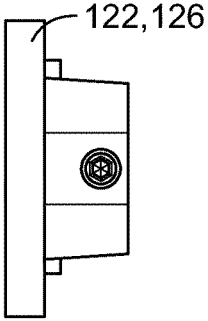
Figure 7B:
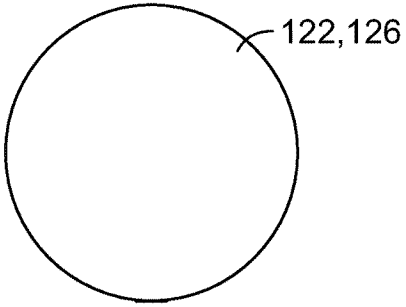

Additionally, as depicted in FIGS. 3-5, a first printed circuit board 136 on which at least one first light source 137 is fixed and a second printed circuit board 138 on which at least one second light source 139 is fixed are arranged within the housing 106. The first circuit board 136 and first light source 137 associated therewith and the second circuit board 138 and second light source 139 associated therewith are spaced from each other at least by the gripper assemblies 108 with the first circuit board 136 and first light source 137 fixable to the first end cap 122 of the housing 106 and the second circuit board 138 and second light source fixable to the second end cap 126 of the housing 106.

As shown in FIGS. 3, 4 and 6A-6C, each first light source 137 and each second light source 139 are light emitting diodes (LEDs) with the first light sources 137 and the second light sources 139 orientated in a same direction to emit light through the diffusers 110, 112. However, the present disclosure should not be limited to light sources 137, 139 being orientated in a same direction as it is contemplated that the light sources 137, 139 can be orientated in opposing directions and/or some of the first light sources 137 and/or some of the second light sources 139 can be orientated in opposing directions. The number of circuit boards 136, 138 should not be limited to a single first circuit board 136 and a single second circuit board 138 as shown. As such, there can be a plurality of first circuit boards 136 and second circuit boards 138 that can be adapted to allow light sources to project in a plurality of directions.

Figure 8:
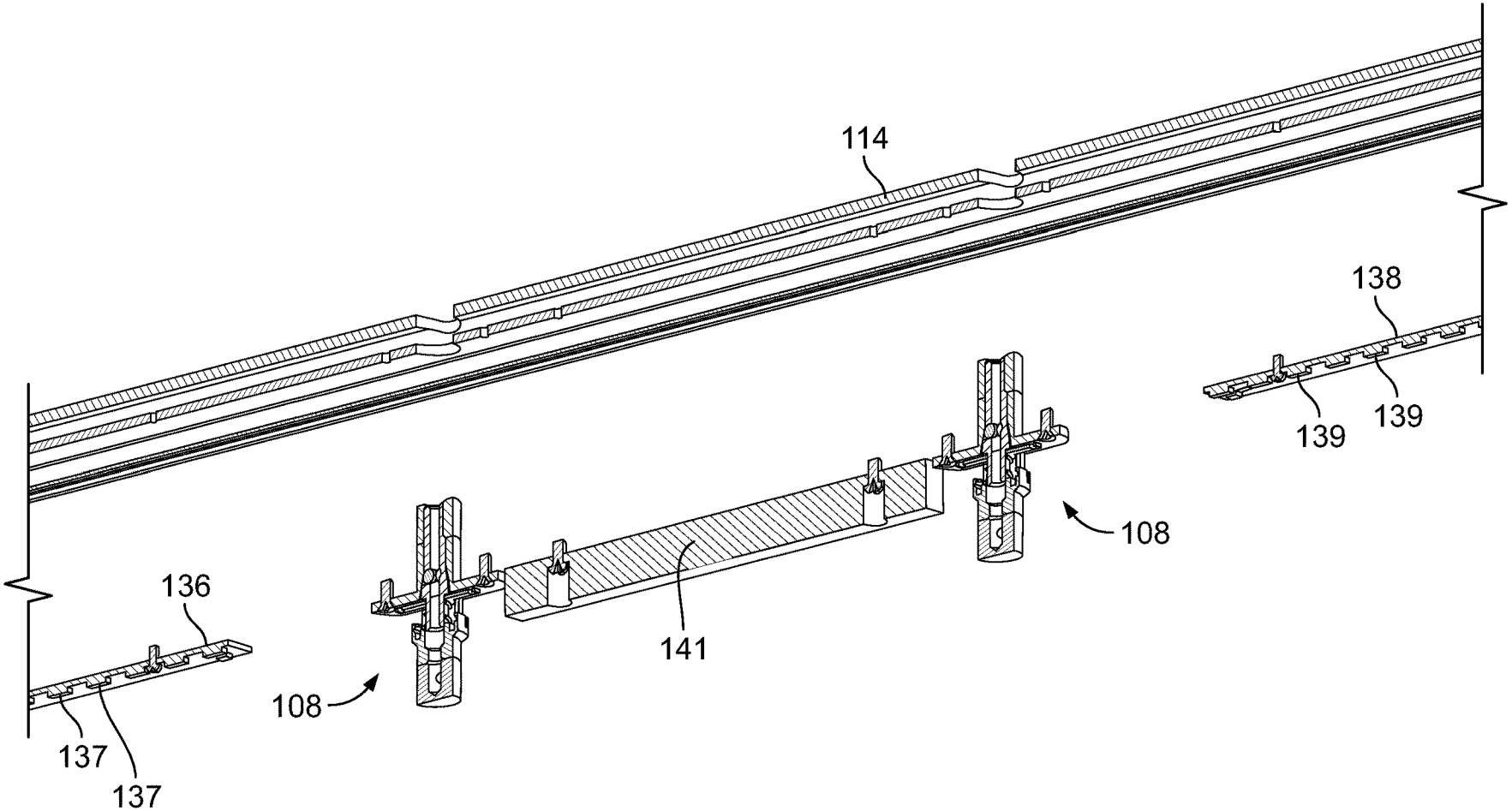
FIG. 8 is a partial cross-sectional view of another pendant housing of a lighting system according to an exemplary embodiment of the present invention.
Figure 9A:
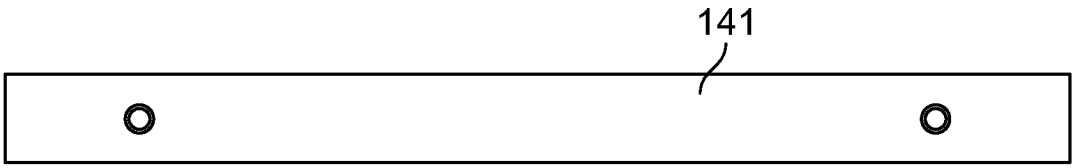
FIGS. 9A-9C are various views of a weight according to an exemplary embodiment of the present invention that can be arranged between gripper assemblies as shown in FIG. 8.
Figure 9B:
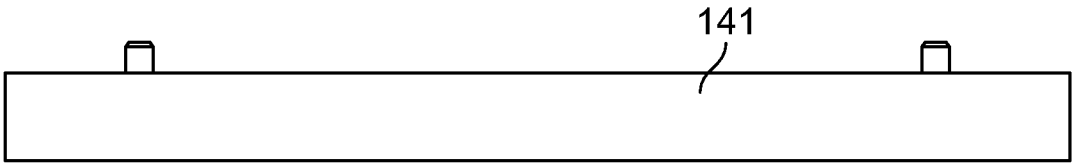
Figure 9C:
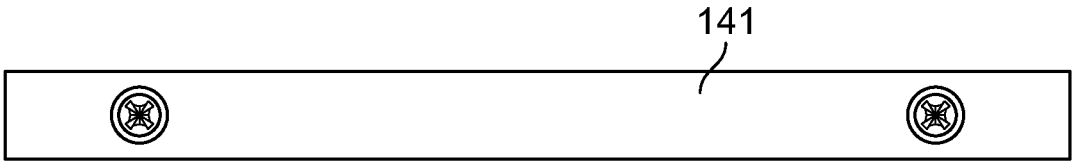
Figure 10E:
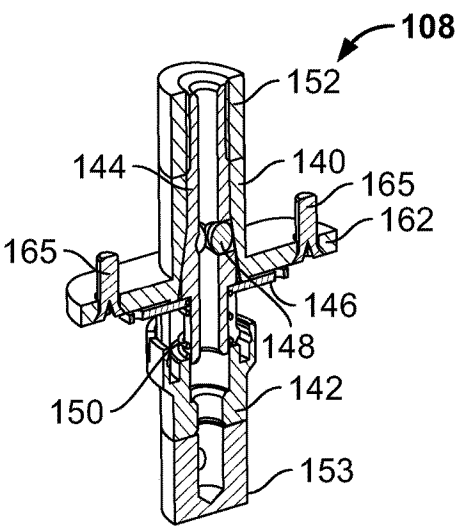
FIGS. 10A-10H are various views of a gripper assembly according to an exemplary embodiment of the present invention.
Figure 10A:
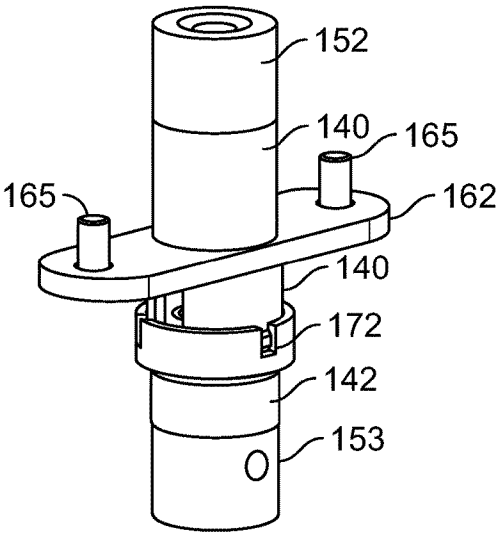
Figure 10D:
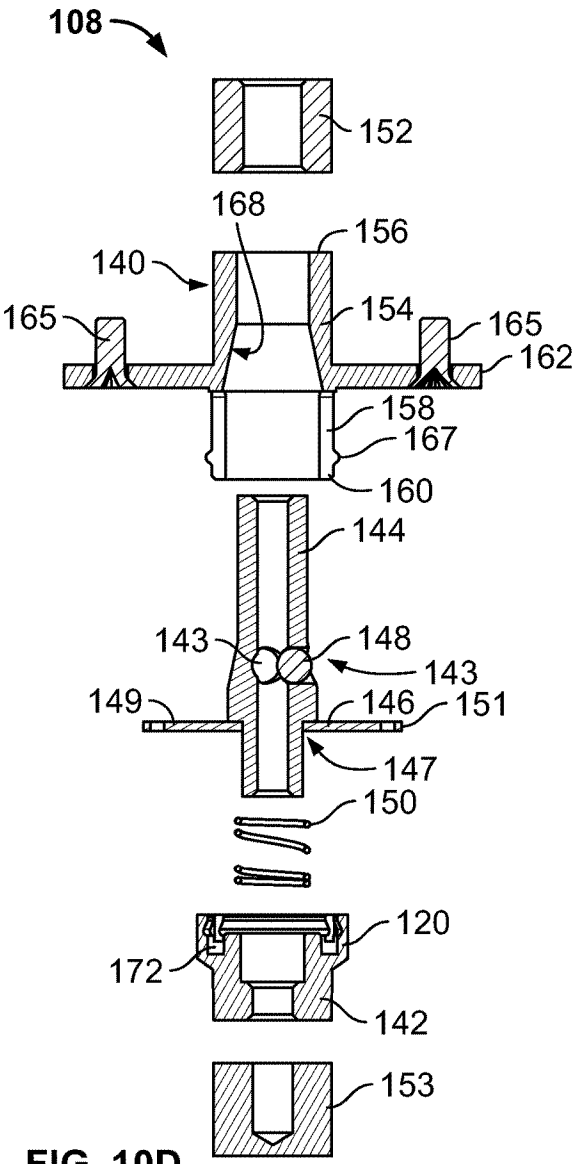
Figure 10C:
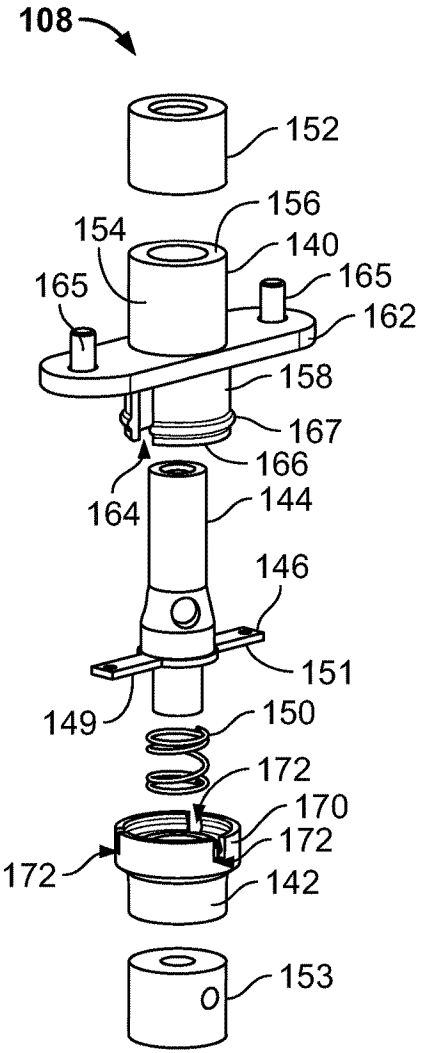
Figure 10B:
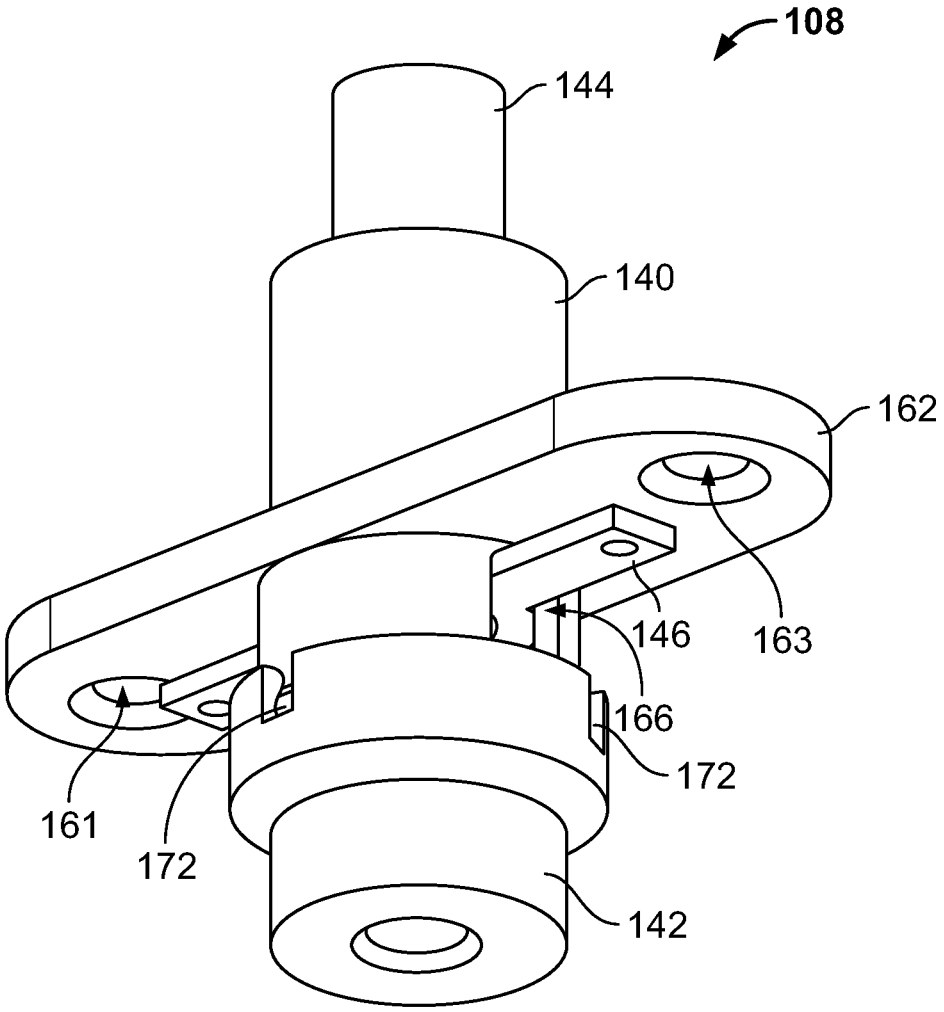
Figure 10F:
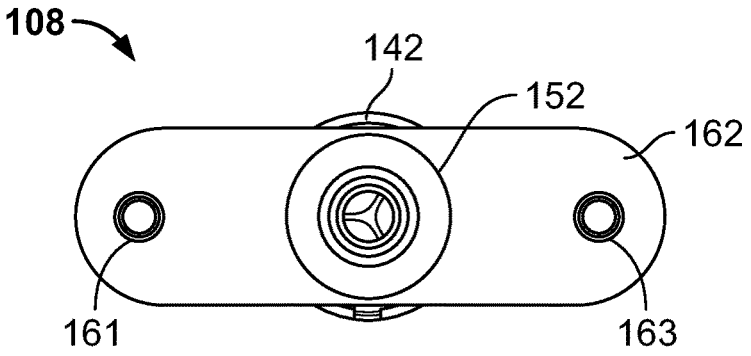
Figure 10G:
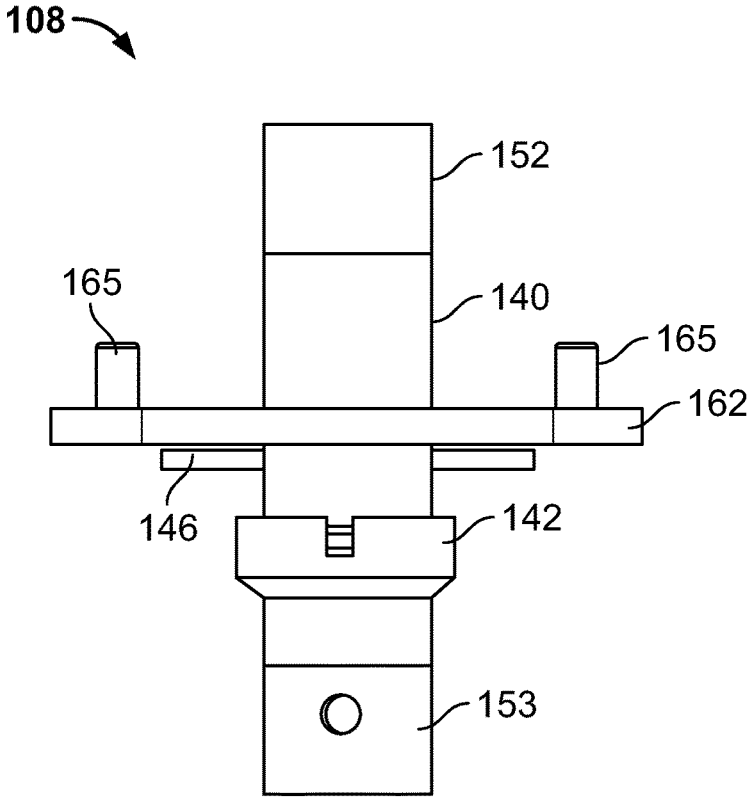
Figure 10H:
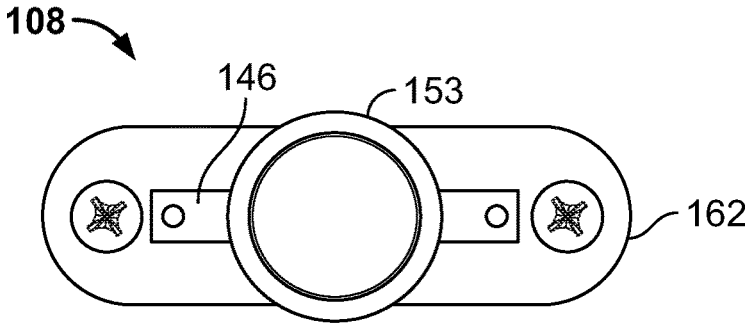

In an exemplary embodiment, as illustrated in FIG. 8, a weight 141 can be arranged within the housing 106, between the gripper assemblies 108 to aid in balancing the lighting system 100. The weight, which is shown in various views in FIGS. 9A-9C, can be included, for example in housing 106 that are arranged the farthest from the canopy 102.

As illustrated in FIGS. 10A-10H, each gripper assembly 108, which are fixed in pairs within each pendant housing 106 and includes both conductive and insulating components, generally comprises a first insulated housing 140, a second insulated housing 142, a plunger 144, a plate 146, a plurality of bearings 148 (e.g., 3 mm ball bearings), a compression spring 150, a first cap 152 and a second cap 153. When installed within a pendant housing 106, the first cap 152 and the plunger 144 extend above the top of the pendant housing 106 and a bottom portion of the second insulted housing 142 and the second end cap 153 extends below the bottom of the pendant housing 106.

The first insulated housing 140, which can be, for example, comprised of a polymeric material such as plastic, is a hollow body that includes a first sidewall 154 that is delimited at a first end 156, a second cylindrical sidewall 158 that is delimited at a second end 160 and a flange 162, which extends substantially transverse to and between the sidewalls 154, 158. The flange 162 includes a first aperture 167 and a second aperture 163 that are configured to receive a fastener 165 (e.g., rivets, screws, etc.) to secure the gripper assembly 108 within the housing 106. A first recess 164 extends from the second end 160 of the first insulated housing 140 toward the flange 162 and a second recess 166, which is mirror opposite the first recess 164, also extends from the second end 160 of the first insulated housing 140 toward the flange 162. The first insulated housing 140 further includes an internal surface 168 that extends about an internal periphery of the housing 140 and tapers from about the base of the recesses 164, 166 toward the first end 156 of the first sidewall 154 with the internal surface extending substantially linearly about a portion of the first sidewall 154 to the distal end 156 thereof.

The second insulated housing 142 which can be, for example, comprised of a polymeric material such as plastic, is a hollow body that includes a flange 170 that has a plurality of grooves 172 that are configured to interact with a rib 161 that protrudes from the second end 160 of the first insulated housing 140 to secure the first and second insulated housings 140, 144 to each other.

The plunger 144 is arranged concentrically within the first and second insulated housings 140, 142, is pre-tensioned by the spring 150 to protrude beyond the first end 156 of the first sidewall 154 of the first insulated housing 140 and can be depressed within the first and second insulated housings 140, 142 in conjunction with the bearings 148 to release the grip on the cables 104A, 104B. The plunger 144 includes at least one opening 143 in which the bearings 148 are arranged and moveable about and internal groove about which the bearings 148 can travel. The plate 146, which is affixed to the plunger 144, is a conductive element that has a first hole 147, which is configured to receive the second end of the plunger 144 and a first wing 149 and a second wing 151 that extend in opposite directions from the first hole 147. The recesses 164, 166 of the first insulated housing 140 allow for the wings 149, 151 of the plate 146 to travel in a vertical direction about the recesses 164, 166 when the plunger 144 is depressed and/or released from a pre-tensioned state. The recesses 164, 166 also allow the wings 149, 151 to protrude from the gripper assembly 108 to provide a surface area external of the gripper assembly 108 for wires to contact the plate 146 and transfer power from one of the cables 104A, 104B through the gripper assembly 108 to the light sources 136, 138.

In an assembled state, each gripper assembly 108 is sized and shaped to define an internal core that is configured to accept one cable of a pair of the cables 104A, 104B therethrough. A first wire and a second wire (not shown) can be fixed (e.g., soldered) to the first wing 149 and the second wing 151, respectively, of the conductor 146 to transmit either a positive or a negative current from a respective one of the cable 104A, 104B arranged in the gripper assembly 108 to each of the circuit boards 136, 138 to power a light source. As such, one gripper assembly 108 through the conductive elements (i.e., the plunger 144, the plate 146, the bearings 148) will transfer a negative current to the first circuit board by a first wire and will transfer a negative current to the second circuit board by a second wire and another gripper assembly 108 through the conductive elements (i.e., the plunger 144, the plate 146, the bearings 148) will transfer a positive current to the first circuit board by a third wire and will transfer a positive current to the second circuit board by a fourth wire so that each circuit board 136, 138 will receive independently a positive and a negative current to illuminate the first and second light sources 137, 139.

Figure 32:
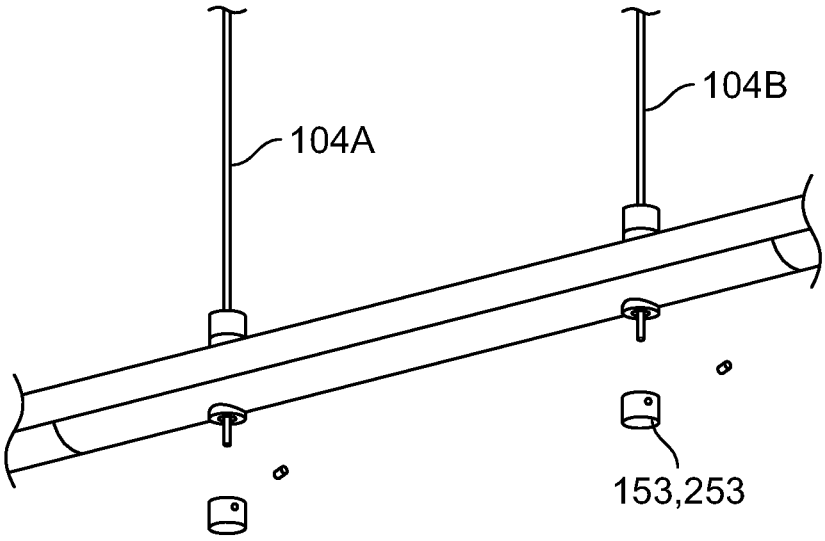

As shown in FIG. 1, to assemble the lighting system 100, which has three tiers of pendant housings 106, and secure each pendant housing 106 at a desired height, a first one of the cables 104A is fed through a first one of a pair of gripper assemblies 108 that is arranged in one of the housings 106 and a second one of the cables 104B is then fed through a second one of the pair of gripper assemblies 108 that is arranged the housings 106. The pendant housing 106 is slidable independently about each cable 104A, 104B to set the housing 106 at a desired position. This process is continued for each additional pendant housing 106 until all of the pendant housings 106 are fixed at a desired position along the cables 104A, 104B. It is noted, as can be seen in FIG. 32, that a portion of each of the cables 104A, 104B, extends beyond the housings 106 that are arranged the farthest from the canopy 102 with the end cap 153 arranged over the protruding portion of each cable 104A, 104B.

Figure 11:
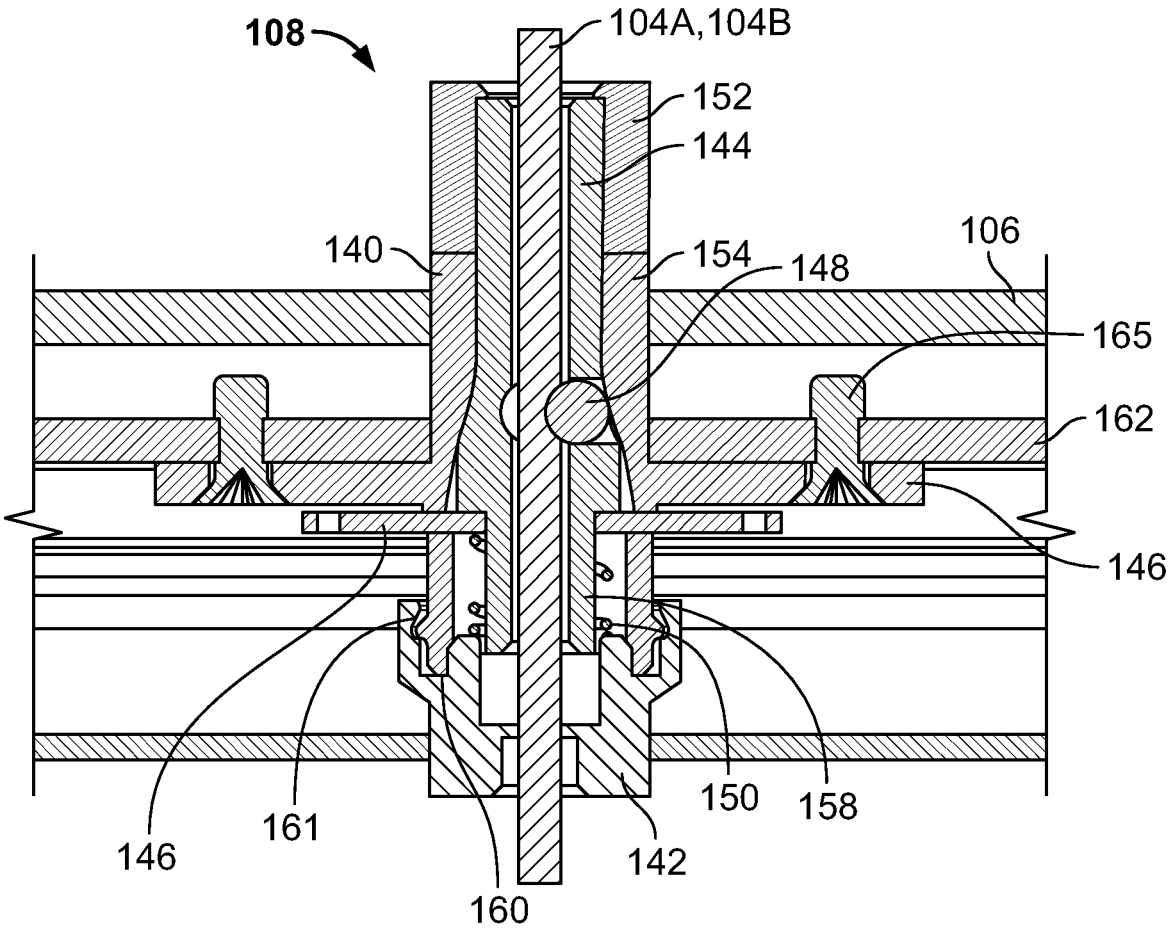
FIG. 11 is a first cross-sectional view of the gripper assembly of FIGS. 10A-10H mounted in a pendant housing with a cable extending therethrough according to an exemplary embodiment of the present invention.
Figure 12:
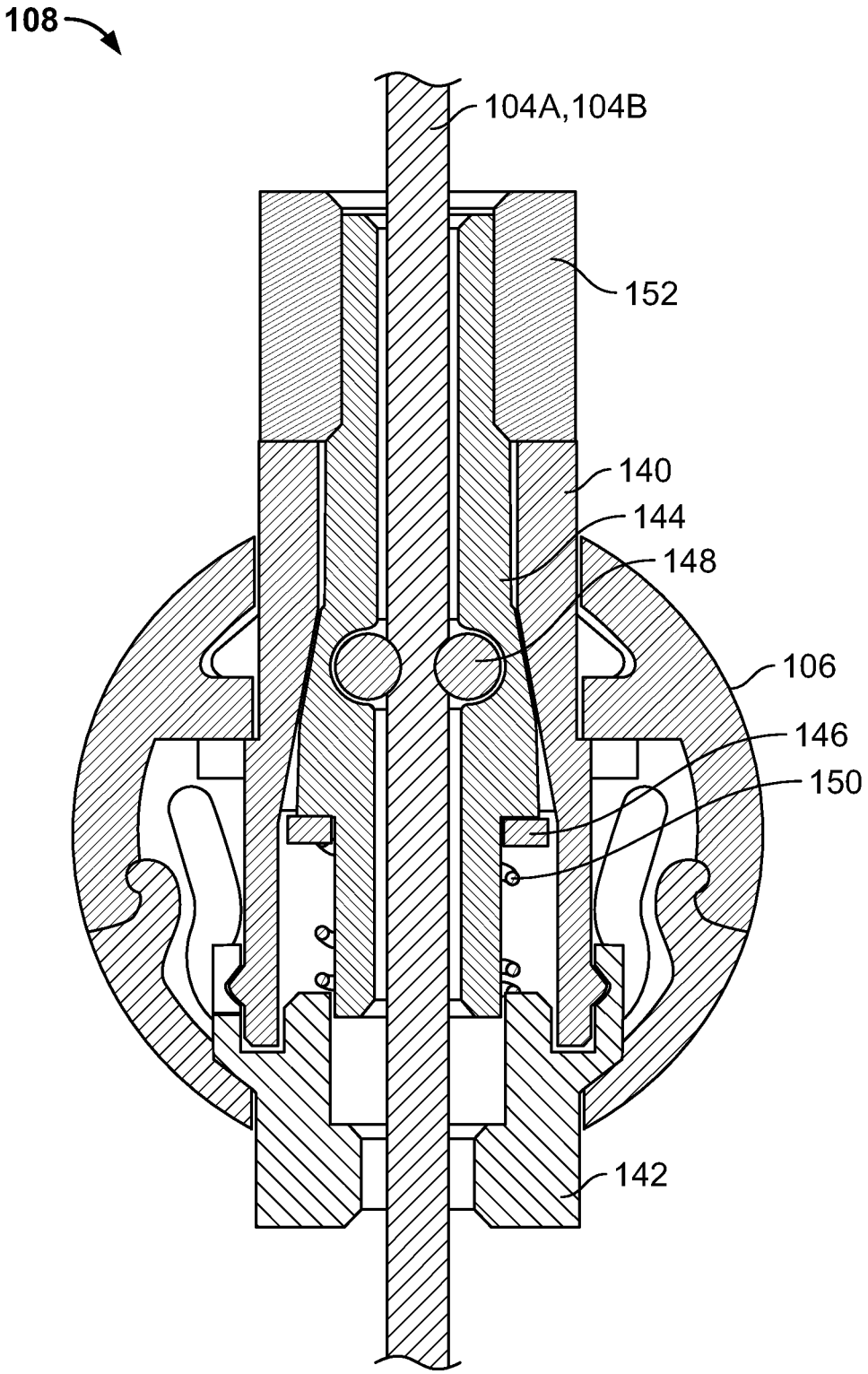
FIG. 12 is a second cross-sectional view of the gripper assembly of FIGS. 10A-10H mounted in the housing with a cable extending therethrough according to an exemplary embodiment of the present invention.
Figure 13:
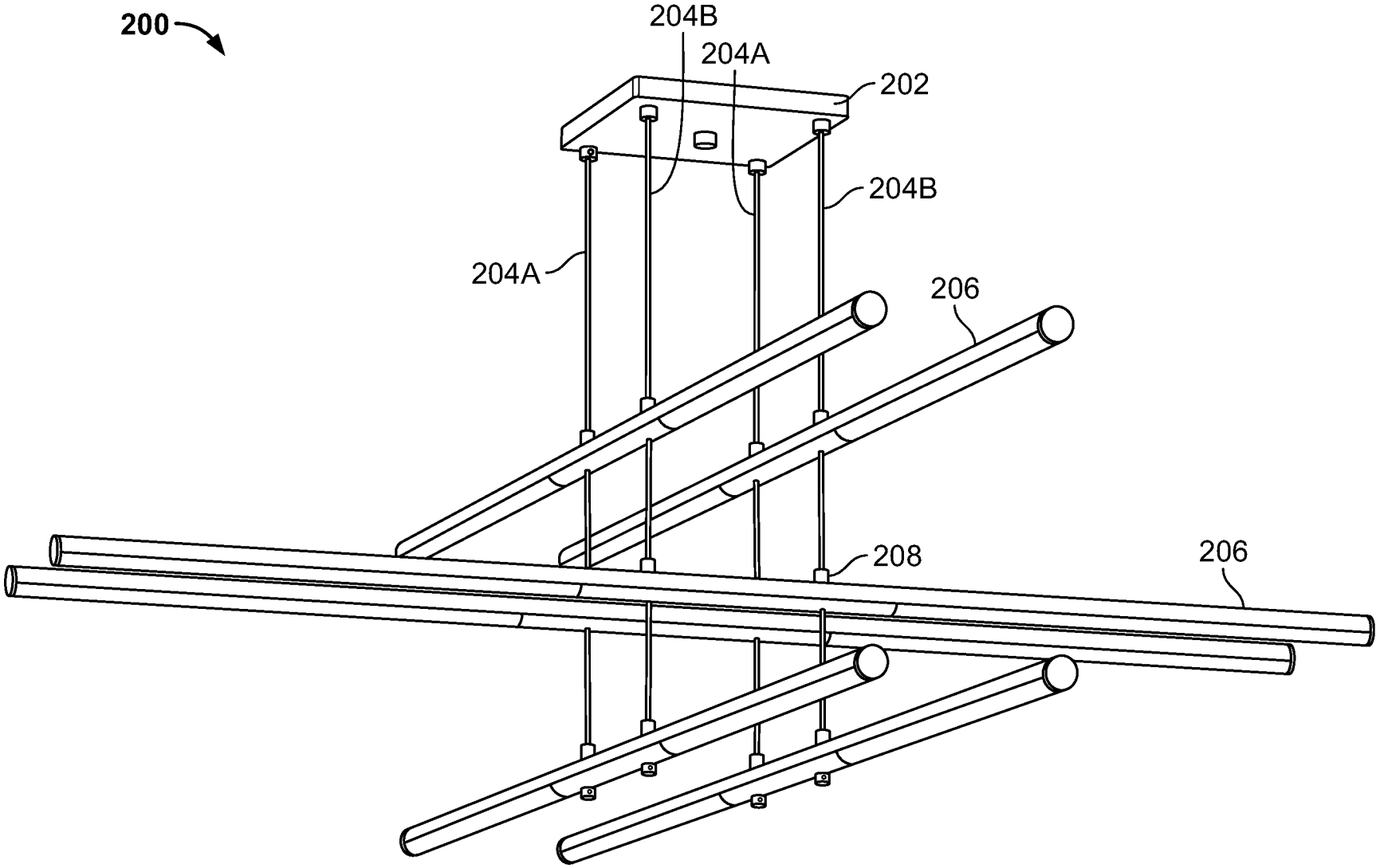
FIG. 13 is a perspective view of lighting system that includes a plurality of pendants according to an exemplary embodiment of the present invention.
Figure 14:
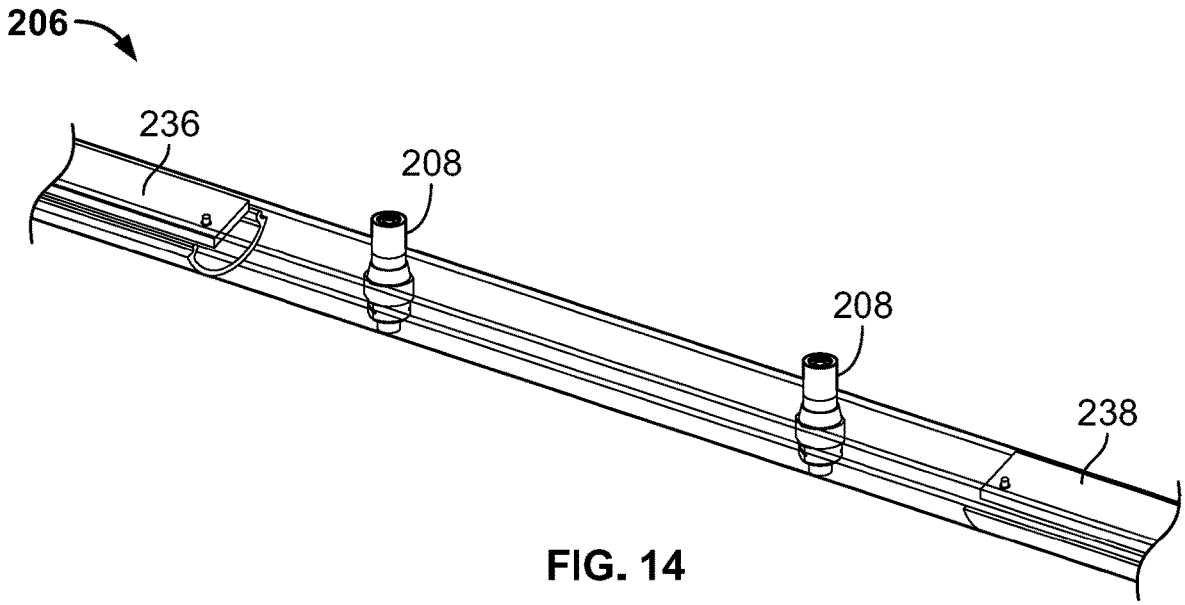
FIG. 14 is a partial perspective view of a section of a pendant of the lighting system of FIG. 13 with gripper assemblies arranged therein according to an exemplary embodiment of the present invention.
Figure 15:
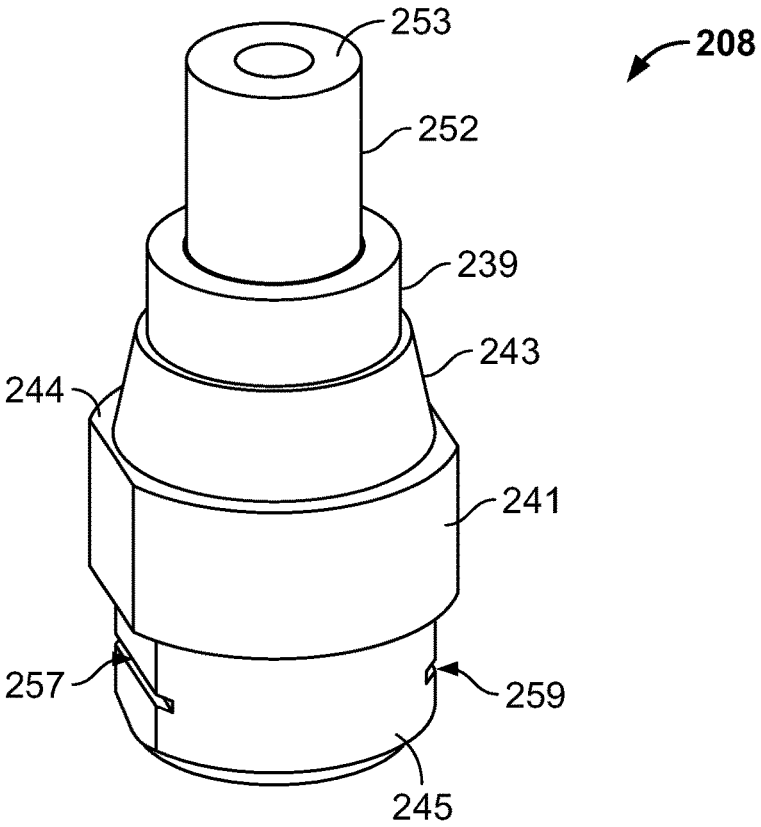
FIG. 15 is a perspective view of a gripper assembly arranged in the pendant of FIG. 14 according to an exemplary embodiment of the present invention.

As shown in FIGS. 11 and 12, the pendant housing 106 is moveably secured at a desired position about the cables 104A, 104B by at least the bearings 148 that are arranged within the plunger 144 of each gripper assembly 108 and configured to apply pressure to the cable 104A, 104B. The plunger 144 is pre-tensioned by the spring 150 to project toward the top of each gripper assembly 108 and contact the internal surface of the first insulated housing 140. The tapered sidewalls of the first insulated housing 140 in conjunction with the tapered sidewall of the plunger 144 both prevent the plunger 144 and bearings 148 from becoming disassociated from the assembly 108 and ensure that the bearings 148 will be prevented from extending external to the plunger 144 and be forced inwardly from the openings of the plunger 144 toward a cable 104A, 104B to grip and apply pressure to the cables 104A, 104B and prevent the pendant housing 106 from sliding about the cables 104A, 104B.

Although the pendant housing 106 can travel along the cables 104A, 104B when the cap 152 is not fixed to the gripper assembly 108 in only a single vertical direction toward the first end 156 of the first housing 140 and distal end of the plunger 144 that protrudes from the assembly 108, to allow the pendant housing 108 to travel in either direction about the cables 104A, 104B, the plunger 144 is depressed toward the second insulated housing 142, allowing the bearings 148 to move into openings in the plunger 144, away from the internal surface area and in turn releasing the pressure being applied to the cables 104A, 104B. When the plunger 144 is depressed, the plate 146 along with the plunger 144 travels toward the second insulated housing 142 with the plate traveling about the recesses 164, 166 of the first housing 140.

Figure 30:
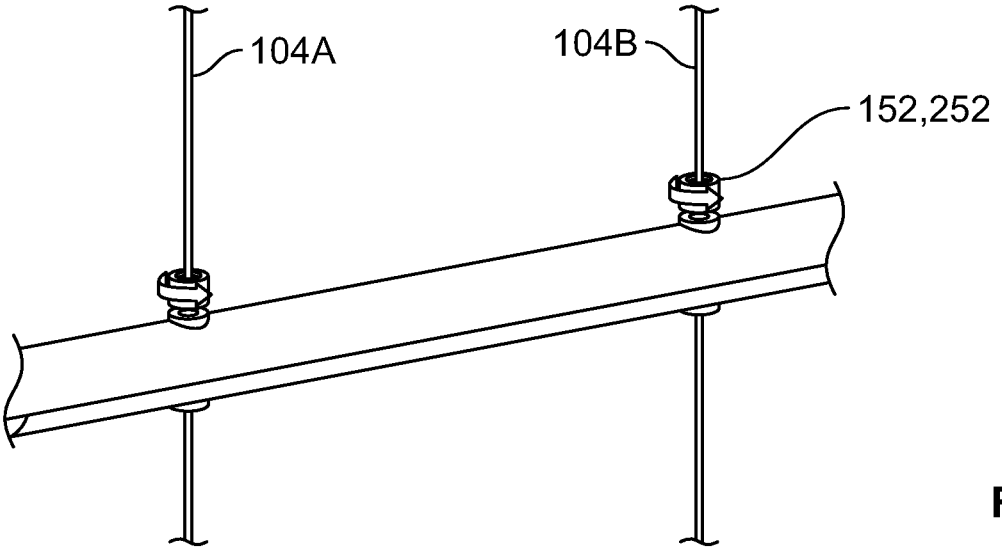
FIGS. 30-32 are a perspective partial assembly view of a lighting system according to an exemplary embodiment of the present invention.
Figure 31:
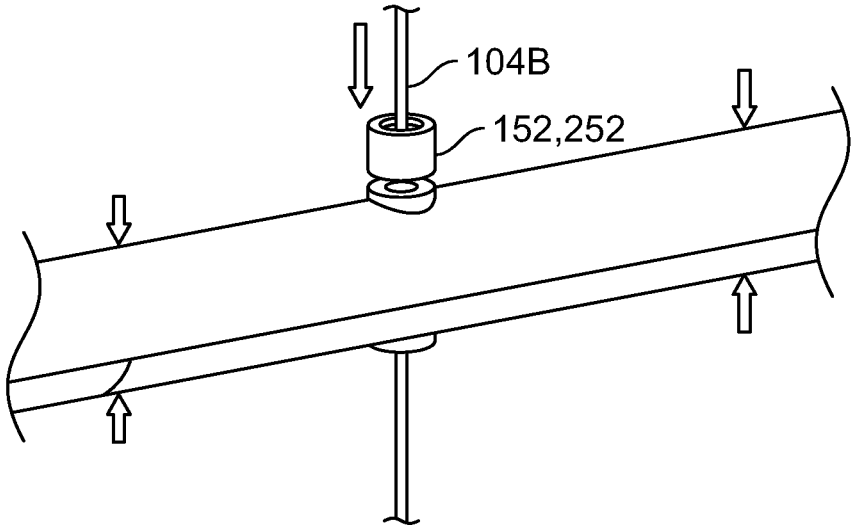

As depicted in FIGS. 30 and 31, to fasten each gripper assembly 108 at a desired location about a cable 104A, 104B, the cap 152, which has internal threading that mates with external threading of the plunger 144, can be tightened. By tightening the end cap 152, the gripper assembly 108 is drawn or pulled upward, towards the cap 152 and in turn forces the bearings 148 to project inwardly from the plunger 144 and grip and constrict the cable 104A, 104B by preventing the bearings 148 from protruding beyond the external surface of the plunger 144. To adjust the height of each pendant assembly 106 about a cable 104A, 104B, the cap 152 must be loosened which in turn allows for the plunger 144 to be depressed and the bearings 148 to move away from the cable 104A, 104B so that the gripper assembly 144 can be adjusted to obtain a desired height and level. If the housing 106 and in turn the gripper 108 was rotated about a cable, the cap 152 is necessary to ensure the housing 106 does not slide down the cables 104A, 104B because the gripper 108 will be orientated to naturally at least somewhat be in a depressed state and there will not be enough friction between the bearings 148 and the cables 104A, 104B to maintain the housing at a desired position about the cables 104A, 104B without the cap 152 drawing the plunger 108 up and in turn forcing the bearings to grip the cables 104A, 104B.

The lighting system 100 can be powered by a conventional AC power supply that provides current to each pendant 106. Electric current travels from a power supply and is divided through each cable 104A, 104B such that each cable 104A, 104B transfers half power from the power supply to the conductive elements 144, 146 of the gripper assembly 108 and through one or more wires to the first and second light sources 137, 139. The cables 104A, 104B are conductive and contain a shell to isolate the electric current. The shell can be made, for example, from aluminum or another known material that is capable of isolating electric current from the outside of the cable 104A, 104B. The first and second insulated housings 140, 142 of the gripper assembly 108 also work to isolate the electric current. As noted above, by isolating electric current, one of the cables 104A associated with each housing 106 transmits a positive electric current and the other cable 104B transmits a negative electric current. For this reason, a pair of cables 104A, 104B and in turn a pair of gripper assemblies 108 must be used for each pendant housing 106 to provide the power to light sources 137, 139.

As discussed generally above, to illuminate at least one first light source 137 arranged in the housing 106, a first wire (not shown) is fixed (e.g, soldered) at a first end to the first wing 149 of the conductive plate 146 of a first gripper assembly 108 which in turn is associated with a cable 104A carrying a positive current and a second end of the first wire is fixed (e.g, soldered) to the first circuit board 136. A second wire (not shown) is fixed (e.g, soldered) at a first end to the first wing 149 of the conductive plate 146 of a second gripper assembly 128 that is associated with a cable 104B carrying a negative current and a second end of the second wire (not shown) is fixed (e.g, soldered) to the first circuit board 136. Thus, both a positive and a negative current are transmitted to the first circuit board 136, which in turn enables the first light source(s) 137 to illuminate.

To illuminate at least one second light source 139 arranged in a housing 106, a third wire not shown) is fixed (e.g, soldered) at a first end to the first wing 149 of the conductive plate 146 of a first gripper assembly 108 associated with the cable carrying a positive current and a second end of the third wire is soldered to the second circuit board 138. A fourth wire (not shown) is fixed (e.g, soldered) to the second wing 151 of the conductive plate 146 of a second gripper assembly 108 that is associated with the cable 204B carrying a negative current and a second end of the fourth wire is soldered to the second circuit board 138. Thus, both a positive and a negative current are transmitted to the second circuit board 138, which in turn enables the second light source(s) 139 to illuminate.

FIGS. 13-17 depict another lighting system 200 according exemplary embodiment of the present disclosure. The lighting system 200, which can, for example, be low voltage, generally includes a canopy 202, cables 204A, 204B and pendant housings 206 and gripper assemblies 208 with the pendant housings 206 suspended horizontally in pairs by two of cables 204A, 204B from the canopy 202.

Figure 28B:
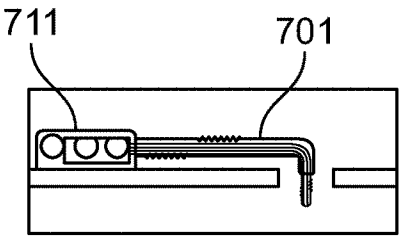
FIGS. 28A-29 are assembly views of gripper assemblies associated with a lighting system according to an exemplary embodiments of the present invention.
Figure 28A:
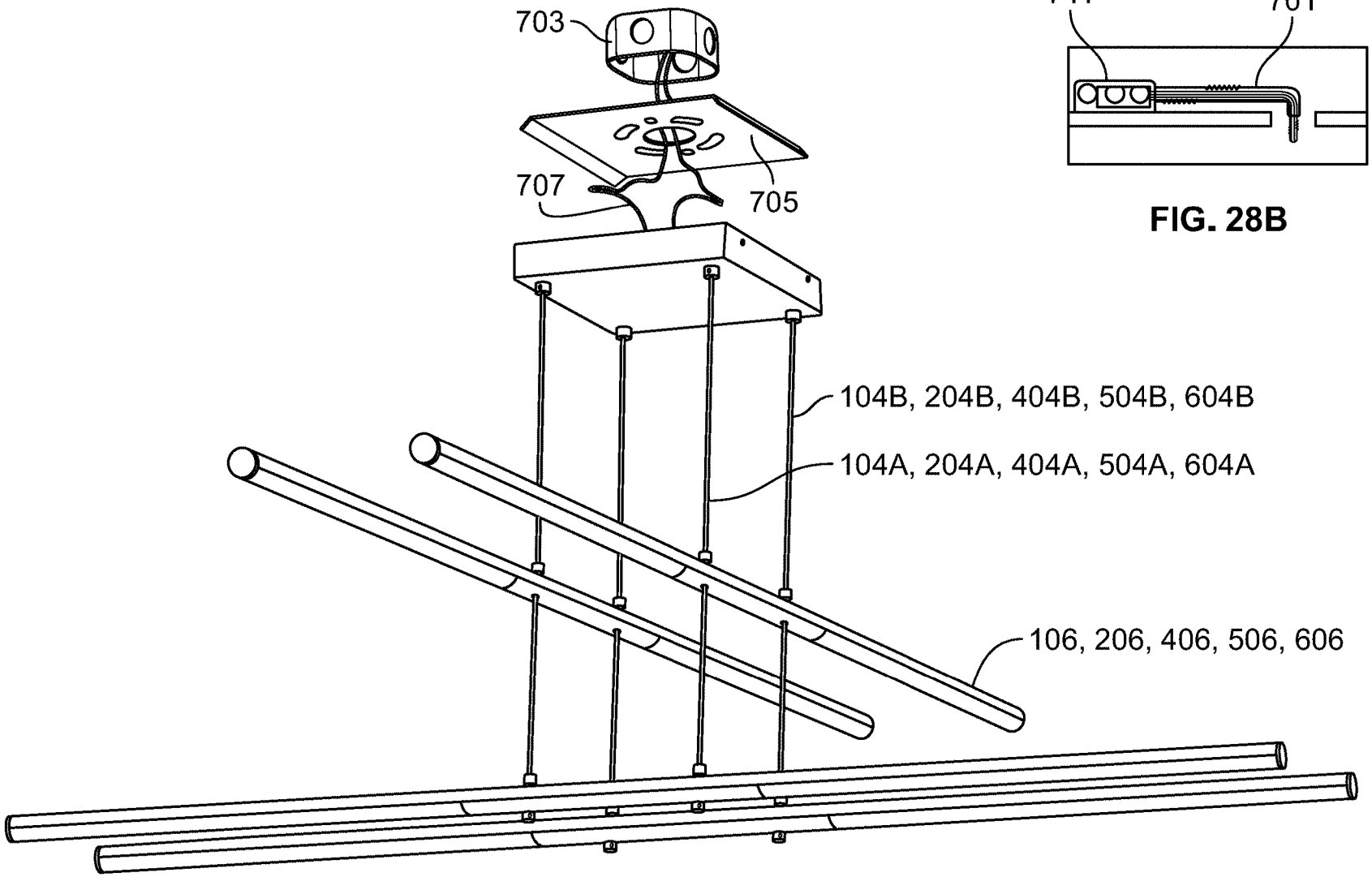
Figure 29:
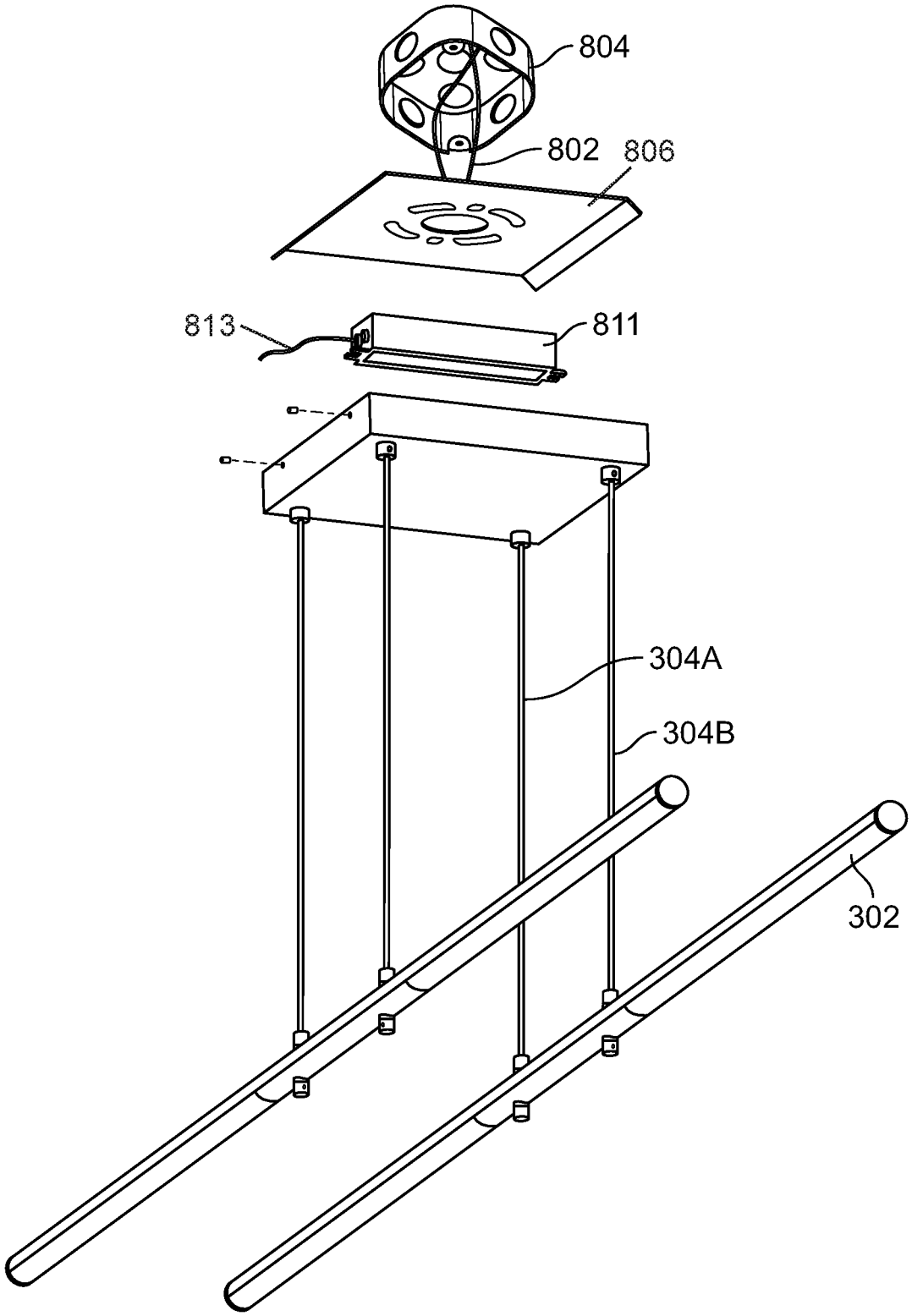

To illuminate at least one light source (not shown), one of the cables 204A transmits a positive electric current and another one of the cables 204B transmits a negative electric current from a power source 711 or 811 that is arranged either within the canopy 202 or proximate to the canopy 202 (see FIGS. 28A through 29). For this reason, a pair of cables 204A, 204B and in turn a pair of gripper assemblies 208 must be used for each pendant housing 206 to provide the power to light source(s).

As depicted in FIGS. 13-17, a pair of gripper assemblies 208 that contain both conductive and insulating components are arranged in each housing 206. The gripper assemblies 208 each generally include a first insulated housing 240, a second insulated housing 242, a plunger 244, a plunger shell 245, a plurality of bearings 248, a key stop 247 and a cap 252 and are fixed within each pendant housing 206 by attachment means (not shown) such as screws. This installation is preferably done by a factory and not by an end user. Once installed, the cap 252 and the plunger 244 of the gripper assembly 208 extends above the top of the pendant housing 206 and a bottom portion of the second insulted housing 242 extends below the bottom of the pendant housing 206.

Figure 16:
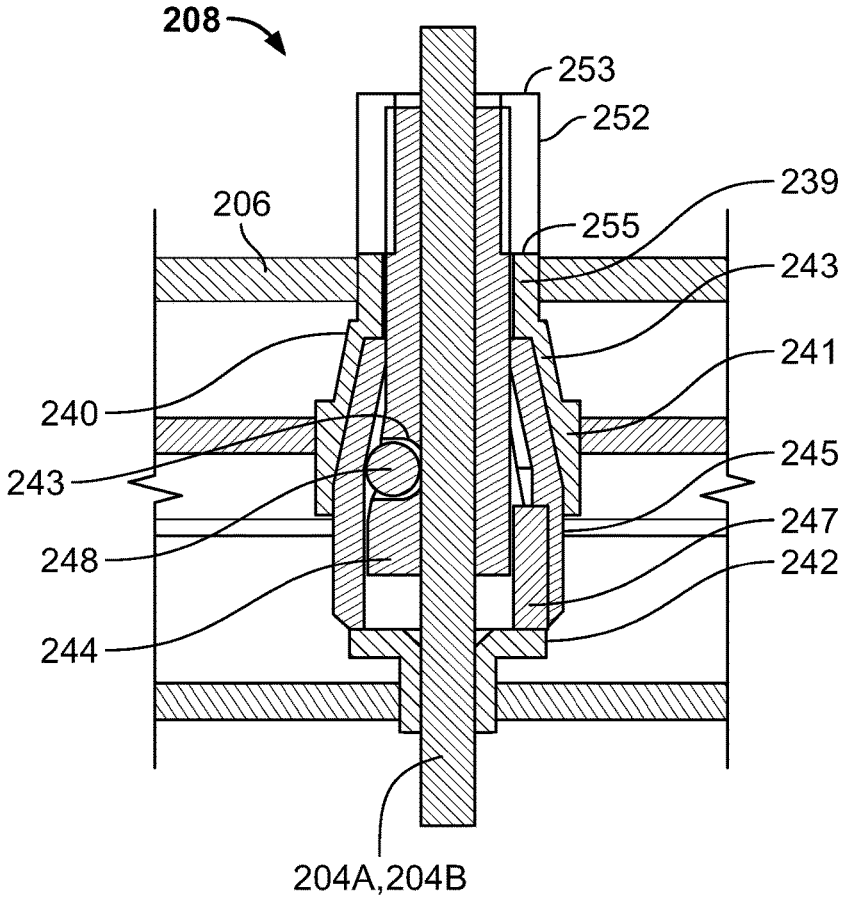
FIG. 16 is a first cross-sectional view of the gripper assembly mounted in a pendant housing of FIG. 14 with a cable extending therethrough according to an exemplary embodiment of the present invention.
Figure 17:
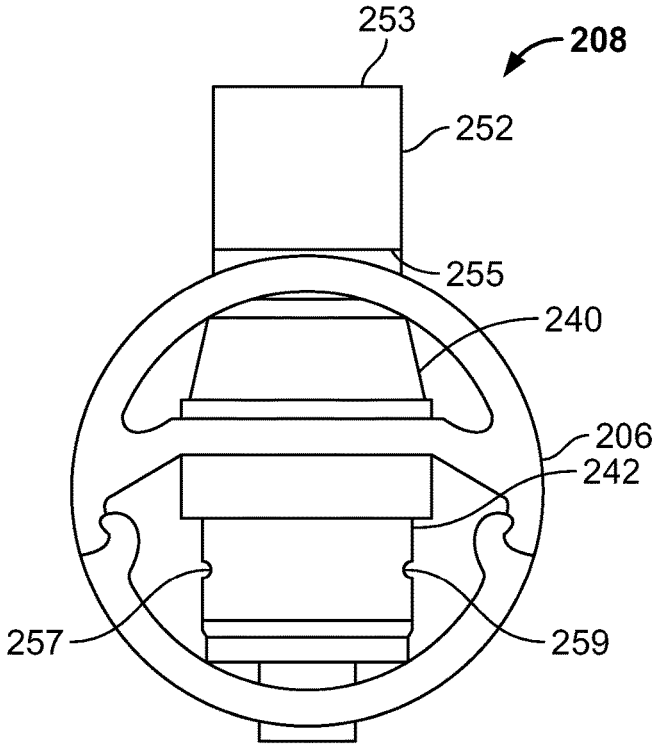
FIG. 17 is a second cross-sectional view of the gripper assembly mounted in the pendant housing of FIG. 14 with a cable extending therethrough according to an exemplary embodiment of the present invention.
Figure 18:
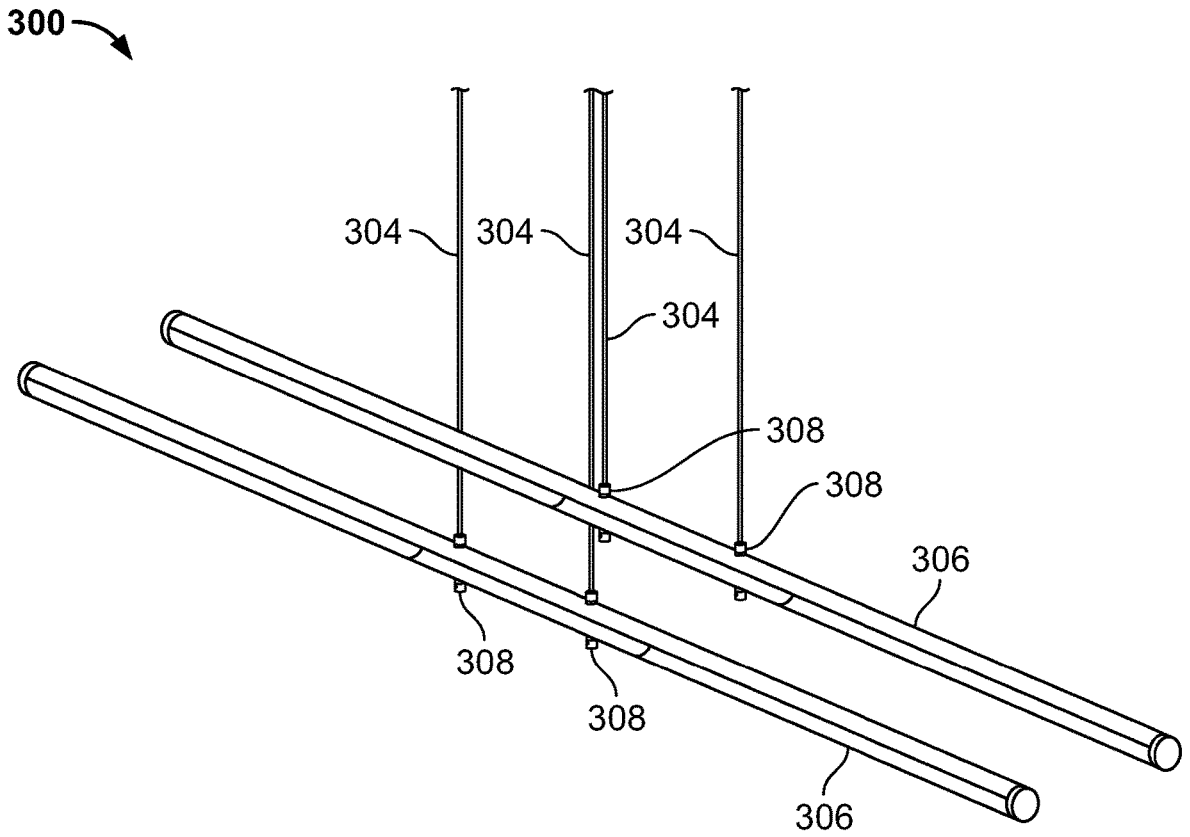
FIG. 18 is a perspective view of a lighting system that includes a single tier of pendants according to an exemplary embodiment of the present invention.
Figure 19:
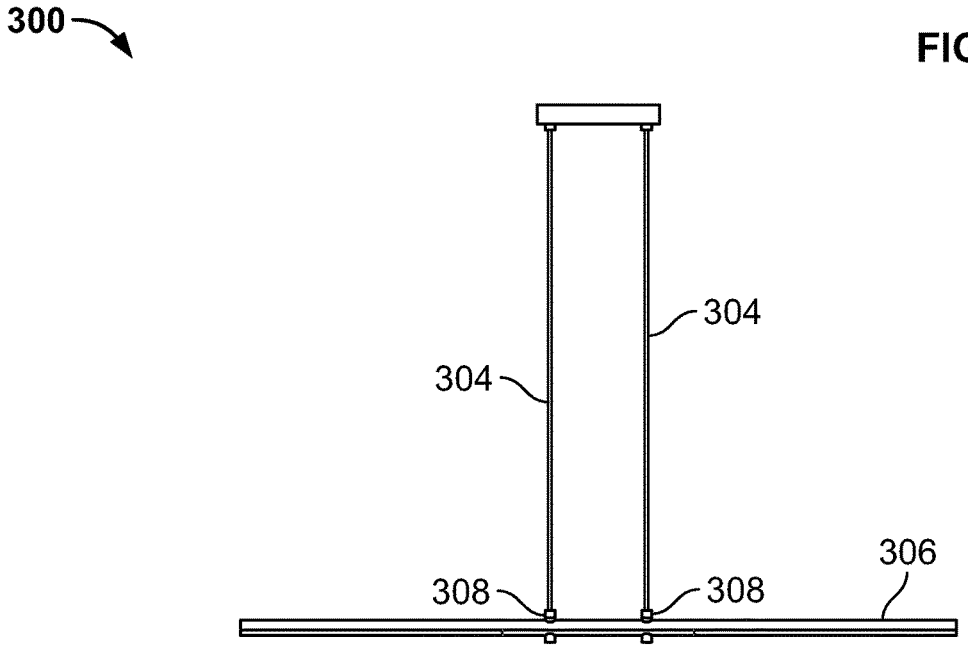
FIG. 19 is a side view of the lighting system of FIG. 18.
Figure 20:
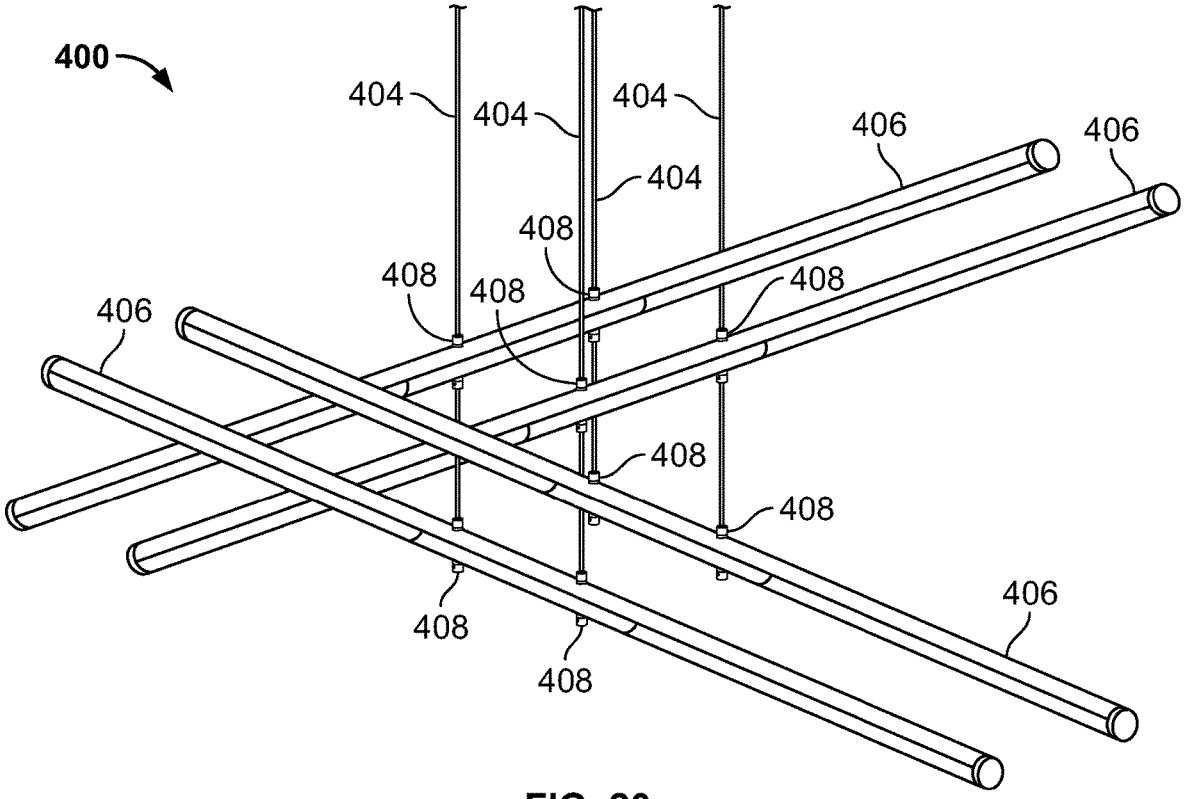
FIG. 20 is a perspective view of a lighting system that includes two tiers of pendants according to an exemplary embodiment of the present invention.
Figure 21:
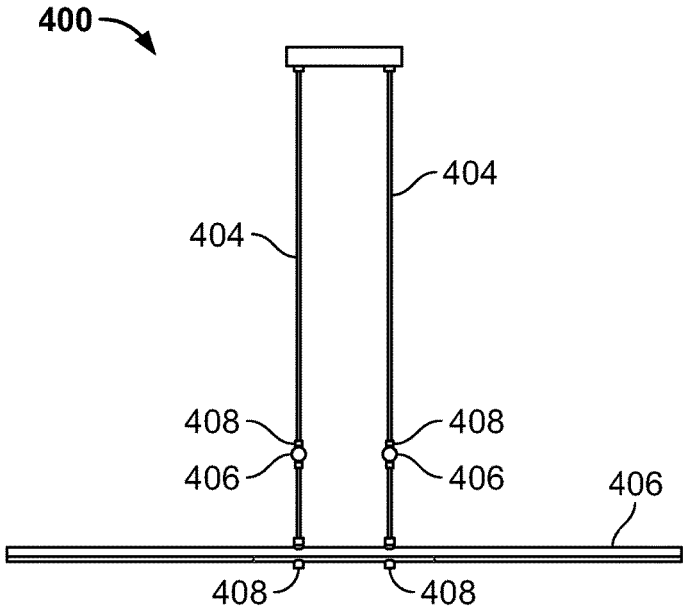
FIG. 21 is a side view of the lighting system of FIG. 20.
Figure 22:
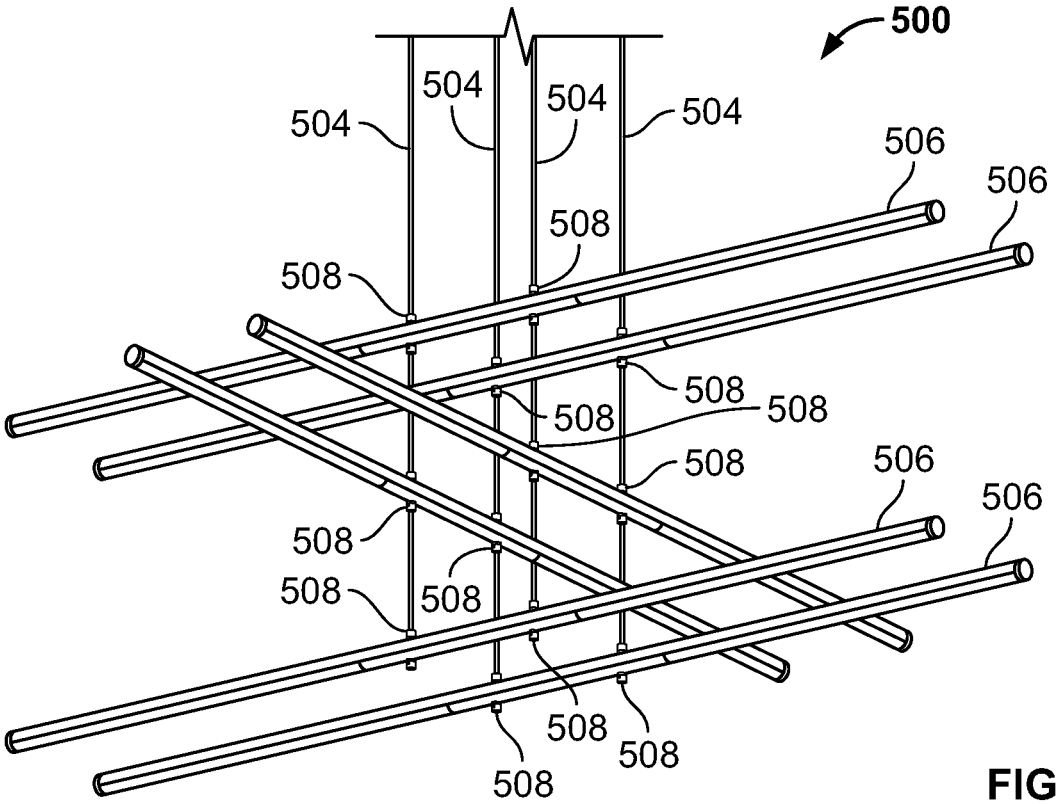
FIG. 22 is a perspective view of a lighting system that includes three tiers of pendants according to an exemplary embodiment of the present invention.
Figure 23:
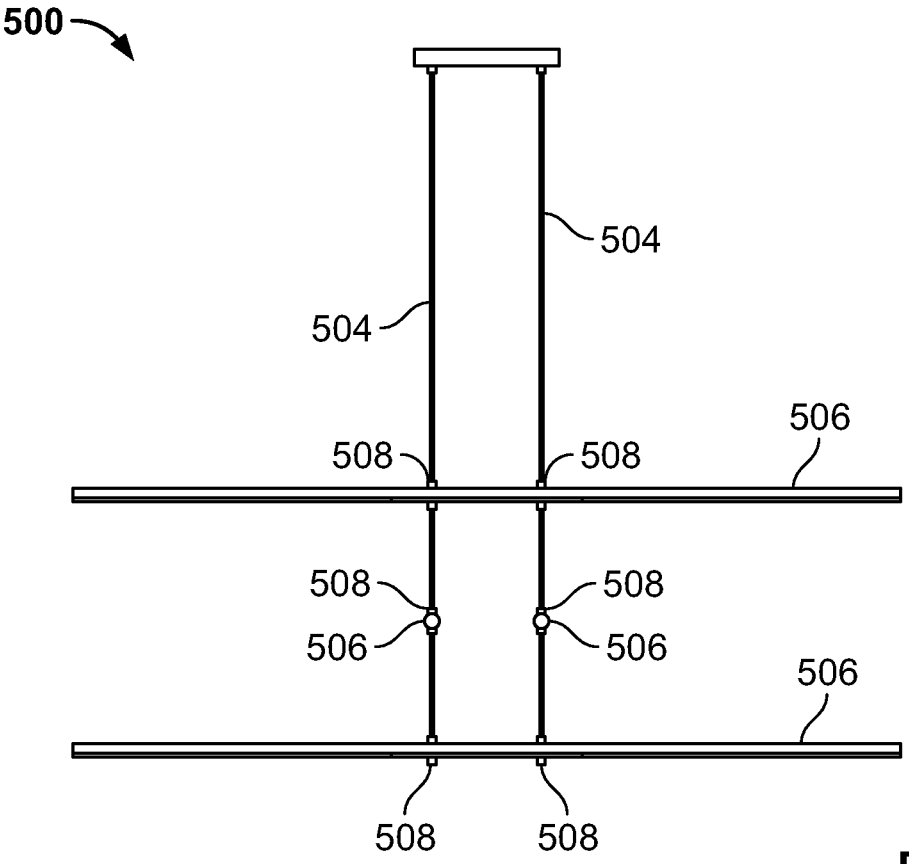
FIGS. 23 and 24 are a side view of the lighting system of FIG. 22.
Figure 24:
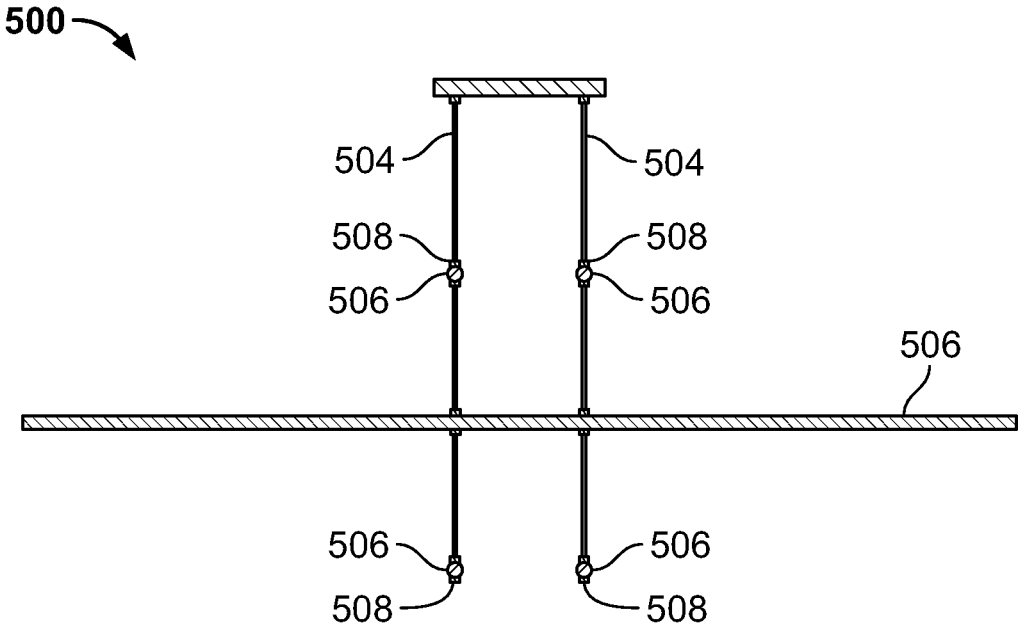
Figure 25:
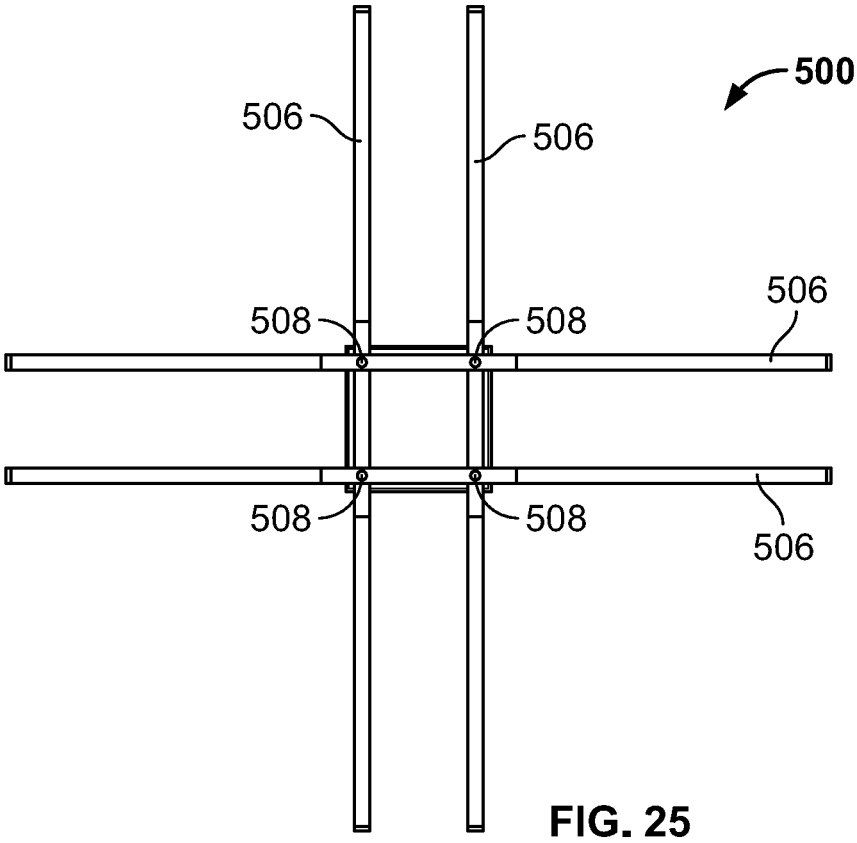
FIG. 25 is a bottom view of the lighting system of FIG. 22.
Figure 26:
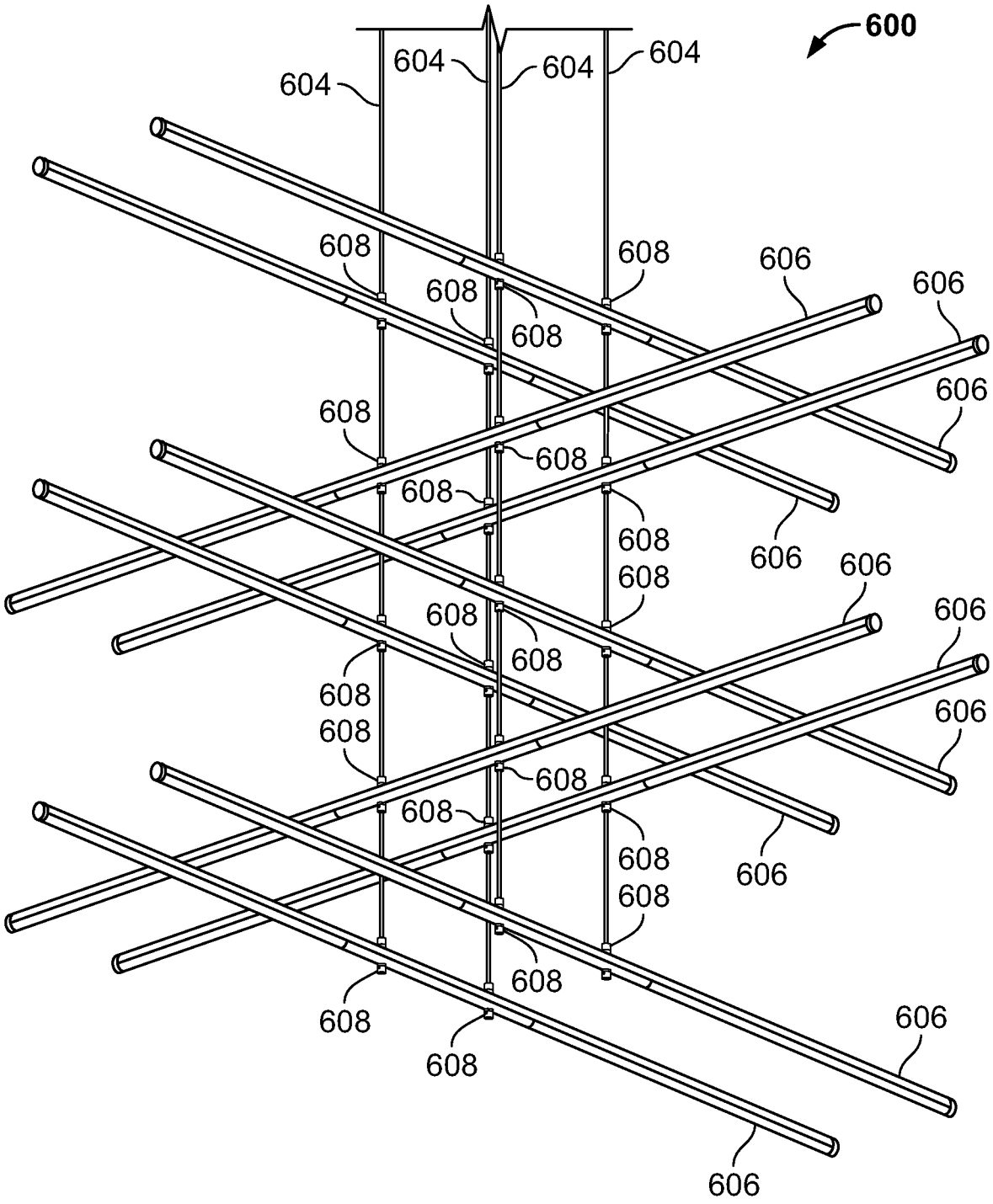
FIG. 26 is a perspective view of a lighting system that includes five tiers of pendants according to an exemplary embodiment of the present invention.
Figure 27:
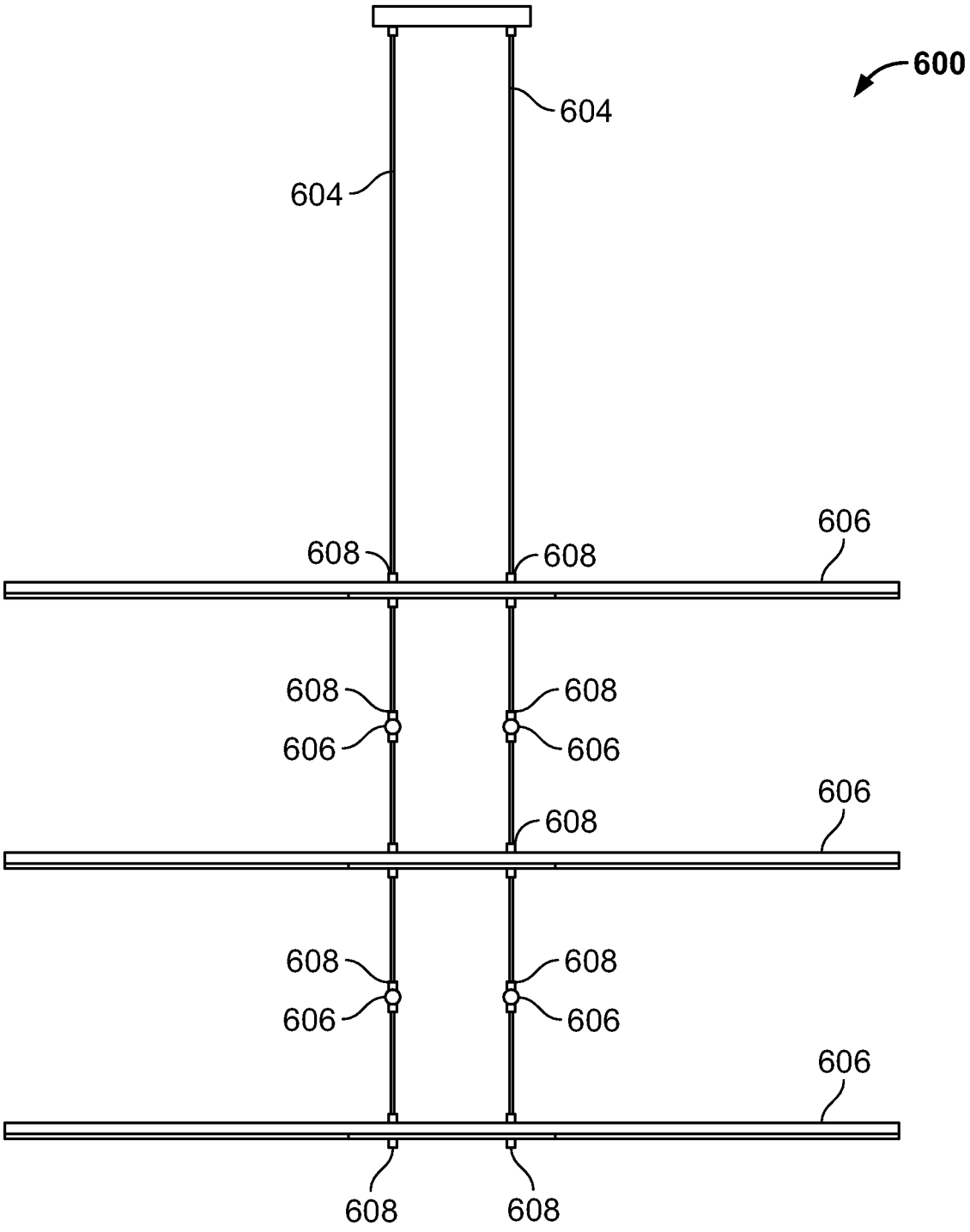
FIG. 27 is a side view of the lighting system of FIG. 26.

The cap 252 is tubular component that is delimited between a first end 253 and a second end 255, is internally threaded and is sized to receive the plunger 244 (as shown in FIG. 16). When the cap 252 is affixed to the gripper assembly 208, the second end 255 of the cap 252 abuts the first insulated housing 240. The first insulated housing 240 is a substantially tubular member that includes a top section 239, a bottom section 241 and a tapered section 243 that extends between the top and bottom sections 239, 241, which together form an internal area that is sized to receive the plunger 244. The diameter of the bottom section 241 is larger than the diameter of the top section 239. The plunger shell 245 is concentrically nested within the tapered section 243 and the bottom section 241 of the first insulated housing 240 and extends beyond a lower end of the first insulated housing 240 where the shell 245 is mateable with the second insulated housing 242. The plunger 244, which houses the bearings 248, is arranged partially within the plunger shell 245 and protrudes beyond the shell 245 and first insulated housing 240. The plunger includes at least one opening and/or groove 243 in which the bearings 248 can be arranged. The key stop 247 is arranged within the plunger shell 245 and contactable with the plunger 244. The second insulted housing 242 is sized to concentrically nest one of the cables 204A, 204B therein and includes a first groove 257 and a second groove 259 that is spaced from the first groove 257 that are each configured to receive a wire (not shown) to transmit either a negative or a positive current from the cable 204A, 204B arranged in the gripper assembly 208 to each of the circuit boards 236, 238 to power a light source. As can be seen, for example, in FIG. 15, the grooves 257, 259 extend inward from an external surface of the second insulated housing 242. In an assembled state, each gripper assembly 208 is sized and shaped to define an internal core that is configured to accept one of the cables 204A, 204B therethrough.

To assemble the lighting system 200, a first one of the cables 204A is fed through a first one of a pair of gripper assemblies 208 that is arranged in one of the pendant housings 206 and a second one of the cables 204B is then fed through a second one of a pair of gripper assemblies 208 that is arranged the housings 206. The housing 206, which can for example, be a tubular body, is slidable independently about each of the cables 204A, 204B to set the housing 206 at a desired position.

The pendant housing 206 is moveably secured at a desired position about the cable 204A, 204B by pressure being applied to the cable 204A, 204B by the bearings 248 within each gripper assembly 208. The plunger 244 is pre-tensioned to project out of the top of the gripper assembly 208. The tapered sidewalls of the plunger shell 245 and the first insulated housing 240 prevent the plunger 244 and bearings 248 from becoming disassociated from the assembly 208 and the key stop 247, which contacts the plunger 244 and gripper shell 245, is configured to prevent rotation of the plunger 244 or other subassembly components of the gripper assembly 208. As such, pressure can be applied to the cable 204A, 204B in one direction even if the cap 252 is not secured to the gripper assembly 208.

Although the pendant housing 206 can travel along the cables 204A, 204B when the gripper assemblies 208 are in a pre-tensioned state, to allow the pendant housing 206 to more easily travel along the cable 204A, 204B, the plunger 244 is depressed toward the second insulated housing 242, expanding surface area in which the bearings 248 can travel within the gripper assembly 208 and in turn releasing the pressure being applied to the cable 204A, 204B.

To fix each gripper assembly 208 at a desired location about a cable 204A, 204B, the cap 252, which has internal threading that mates with external threading of the plunger 244, can be tightened. By tightening the end cap 252, the gripper assembly 244 is drawn or pulled upwards towards the cap 252 and in turn squeezes the plunger 244 and forces the bearings 248 to grip and constrict the cable 204A, 204B. The key stop 247 aids to prevent the gripper assembly 208 from spinning. To adjust the height of each pendant assembly 206 about a cable 204A, 204B, the cap 252 must be loosened which in turn allows for movement of the bearings 248 away from the cable 204A, 204B so that the gripper assembly 208 becomes loose and can be adjusted to obtain a desired height and level.

To illuminate the first light source(s) arranged in a housing 206, a first wire is fixed (e.g, soldered) at a first end within the first groove 257 of the plunger shell 245 of the first gripper assembly 208 associated with a cable 204A carrying a positive current and a second end of the first wire is fixed (e.g, soldered) to the first circuit board 236. A second wire is fixed (e.g, soldered) at a first end within a first groove 257 of the plunger shell 245 of the second gripper assembly 208 that is associated with a cable carrying a negative current and a second end of the second wire is fixed (e.g, soldered) to the first circuit board 236 such that both a positive and a negative current are transmitted to the first circuit board 236 which in turn enables the first light source(s) to illuminate.

To illuminate the second light source(s) arranged in a housing 206, a third wire is fixed (e.g, soldered) at a first end within a second groove 259 of the plunger shell 245 of the first gripper assembly 208 associated with the cable carrying a positive current. A second end of the third wire is fixed (e.g, soldered) to the second circuit board 238 and a fourth wire is fixed (e.g, soldered) at a first end within a second groove 259 of the plunger shell 245 of the second gripper assembly 208 that is associated with the cable 204B carrying a negative current and a second end of the second wire is fixed (e.g, soldered) to the second circuit board 238 such that both a positive and a negative current are transmitted to the second circuit board 238 which in turn enables the second light source(s) to illuminate.

FIGS. 18-27 depict various exemplary embodiments of lighting systems 300, 400, 500, 600 that include the same components of the lighting systems 100, 200 described above including a plurality of 304, 404, 504, 604, a plurality of housings 306, 406, 506, 606 and a plurality of grippers 308, 408, 508, 608. The grippers 308 through 608 can be either identical to the grippers 108 included in the lighting system 100 of FIGS. 1-12 or the grippers 208 included in the lighting system 200 of FIGS. 14-17. Although the lighting systems 100-600 depict one, two, three and five tiers, the number of tiers can be any desired and should not be limited to the number of tiers depicted herein.

FIG. 28A depicts an assembly view of an installation of the lighting systems 100, 200. The assembly is also applicable to the lighting systems depicted in FIGS. 20-27. The lighting system, includes a driver 711 (see FIG. 28B) that is installed in a remote and accessible location near the lighting system 100, 200, 400, 500, 600 (e.g., above the ceiling near the canopy 102, 202, etc.). The output wires 701 extend from the driver 711 into an outlet box 703 and a mounting plate 705 that is attached to the outlet box 705 and connect with fixture input wires 707 to power the light sources and illuminate the housings 106, 206, 406, 506, 606.

FIG. 29 depicts an assembly view of an installation of the lighting system 300. The lighting system output wires 802 that extend into an outlet box 804 and through a mounting plate 806 and attach to the driver 811 at one location with fixture input wires 813 connected at another location of the driver 811 to power the light sources and illuminate the housings.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A lighting system, comprising:

a housing configured to allow light to be emitted therethrough;

at least one light source arranged within the housing;

a first cable configured to transmit one of a positive current and a negative current;

a second cable that is spaced from the first cable and configured to transmit the other of a positive current and a negative current;

a first gripper assembly arranged within the housing and configured to receive the first cable; and a second gripper assembly arranged within the housing and configured to receive the second cable;

wherein, when the first gripper assembly and the second gripper assembly are secured to the first cable and the second cable, respectively, the positive current and the negative current are transferable to the at least one light source to illuminate the at least one light source, and wherein the first gripper assembly includes a housing member, a plunger that is arranged concentric within the housing member, a plurality of bearings that extend about an internal surface of the plunger and a plate that is contactable with the plunger.

2. The lighting system of claim 1, wherein the housing include a first enclosure member, a second enclosure member and at least one diffuser through which light can be emitted therethrough.

3. The lighting system of claim 1, wherein the housing is delimited at a first end by a first end cap and at a second end by a second end cap.

4. The lighting system of claim 1, further comprising at least one printed circuit board with the at least one light source is affixed to the at least one printed circuit board that is configured to project light from the housing and illuminate a space.

5. The lighting system of claim 1, wherein the at least one light source is a plurality of light-emitting diodes.

6. The lighting system of claim 1, further comprising at least one first printed circuit board with the at least one light source is affixed to the at least one first printed circuit board and at least one second printed circuit board and at least one second light source that is affixed to the at least one second printed circuit board.

7. The lighting system of claim 3, further comprising at least one first printed circuit board that is fixed at one end to the first end cap and at least one second printed circuit board that is fixed at one end to the second end cap.

8. The lighting system of claim 1, wherein the housing member of the first gripper assembly is comprised of first housing member and a second housing member that is affixable to the first housing member and the second gripper assembly includes a first housing member and a second housing member that is affixable to the first housing member.

9. The lighting system of claim 8, wherein the first housing member and the second housing member of the first gripper assembly and the second gripper assembly are insulating components.

10. The lighting system of claim 8, wherein the first housing member and the second housing member of the first gripper assembly and the second gripper assembly are comprised of a polymeric material.

11. The lighting system of claim 1, wherein the second gripper assembly includes a housing member, a plunger that is arranged concentric within the housing member, a plurality of bearings that extend about an internal surface of the plunger and a plate that is contactable with the plunger.

12. The lighting system of claim 11, wherein the plunger and the plate of each of the first gripper assembly and the second gripper assembly are conductive elements that are configured to transfer electricity from the first cable and the second cable to the at least one light source.

13. The lighting system of claim 1, wherein the housing member includes a recess through which the plate extends and a pre-tensioned spring that is arranged within the housing and configured to tension the plunger against an internal surface of the housing.

14. The lighting system of claim 13, wherein, when the plunger is depressed within the housing, the plate travels about the recess.

15. The lighting system of claim 1, wherein the plunger has openings in which the bearings are moveably housed and in a first state, when the plunger is pulled upward, the bearings are forced inward and contact the first cable and creating a friction force with the first cable to prevent movement of the housing about the first cable and the second cable and, in a second state, when the plunger is depressed, the bearings are moveable, away from the first cable and the second cable, releasing the friction force between the bearings and the first cable.

16. The lighting system of claim 1, further comprising a cap that is configured to extend over an end of the plunger and be secured to the plunger, drawing the plunger up within the housing, forcing the bearings to grip and hold the first cable, fixing the first gripper assembly at a position about the first cable.

17. The lighting system of claim 1, wherein the first cable extends beyond the housing and the first gripper assembly and the second cable extends beyond the housing and the second gripper assembly.

18. A lighting system, comprising:

a housing configured to allow light to be emitted therethrough;

at least one light source arranged within the housing;

a first cable that is configured to transmit one of a positive current and a negative current;

a second cable that is spaced from the first cable and configured to transmit the other of a positive current and a negative current;

a first gripper assembly arranged within the housing and configured to receive the first cable; and a second gripper assembly arranged within the housing and configured to receive the second cable, wherein, when the first gripper assembly and the second gripper assembly are secured to the first cable and the second cable, respectively, the positive current and the negative current are transferable to the at least one light source to illuminate the at least one light source, wherein the first gripper assembly includes a first housing member and a second housing member that is affixable to the first housing member, and wherein the first housing member includes a flange, a first sidewall that extends in a first direction from the flange and a second sidewall that extends in a second direction from the flange.

19. The lighting system of claim 18, wherein the first sidewall includes a tapered internal surface and the second sidewall includes a recess, and the first gripper assembly further includes a plate affixed to the plunger that extends through the recess.

20. A method of assembling a lighting system, the method comprising:

providing a first cable configured to transmit a positive current, a second cable configured to transmit a negative current, a housing, a pair of gripper assemblies arranged within the housing and at least one light source arranged in the housing;

feeding the first cable through a first one of the gripper assemblies;

feeding the second cable through a second one of the gripper assemblies;

adjusting the position of the housing about the first cable and the second cable; and securing the pair of gripper assemblies at a position about the first cable and the second cable, wherein the first one of the pair of gripper assemblies includes a housing member, a plunger that is arranged concentric within the housing member, a plurality of bearing that extend about an internal surface of the plunger and a plate that is contactable with the plunger.

21. The method of claim 20, wherein the second one of the pair of gripper assemblies includes a housing member, a plunger that is arranged concentric within the housing member, a plurality of bearings that extend about an internal surface of the plunger and a plate that is contactable with the plunger.

22. The method of claim 20, further comprising the step of moving the plunger in an upward direction which in turn forces the bearings to move inwardly toward the first cable to grip and hold the first cable, fixing the first one of the pair of gripper assemblies at a position about the first cable.

23. The method of claim 21, wherein each of the gripper assemblies further includes a cap, and the method further comprises the step of placing the cap over an end of the plunger of each respective gripper assembly and securing the cap to the plunger, which in turn forces the plunger to move in an upward direction within the housing and the bearings that are arranged within the plunger toward the first cable and the second cable to grip and hold the first cable and the second cable, fixing the housings at a position about the first cable and the second cable.

24. The method of claim 20, further comprising the step of depressing the plunger to release pressure applied by the bearings on the first cable.

* * * * *